US007229727B2

(12) United States Patent
Itakura et al.

(10) Patent No.: US 7,229,727 B2
(45) Date of Patent: Jun. 12, 2007

(54) COLOR TONER, AND FULL-COLOR IMAGE FORMING METHOD

(75) Inventors: Takayuki Itakura, Shizuoka (JP); Takaaki Kotaki, Shizuoka (JP); Takaaki Kaya, Shizuoka (JP); Kazuhiko Hayami, Shizuoka (JP); Nozomu Komatsu, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 121 days.

(21) Appl. No.: 10/994,344

(22) Filed: Nov. 23, 2004

(65) Prior Publication Data

US 2005/0070631 A1 Mar. 31, 2005

Related U.S. Application Data

(62) Division of application No. 10/345,483, filed on Jan. 17, 2003, now Pat. No. 6,905,808.

(30) Foreign Application Priority Data

Jan. 18, 2002 (JP) ..... 2002-009626

(51) Int. Cl.
*G03G 9/09* (2006.01)

(52) U.S. Cl. ..... 430/45; 430/108.21; 430/108.24

(58) Field of Classification Search ..... 430/45, 430/108.21, 108.23, 108.24
See application file for complete search history.

(56) References Cited

U.S. PATENT DOCUMENTS

| | | | | |
|---|---|---|---|---|
| 3,998,747 | A | 12/1976 | Yamakami et al. | 252/62.1 R |
| 4,301,355 | A | 11/1981 | Kimbrough et al. | 219/137 PS |
| 4,312,932 | A | 1/1982 | Hauser et al. | 430/45 |
| 4,400,515 | A | 8/1983 | Fuchs et al. | 546/57 |
| 4,777,105 | A | 10/1988 | Macholdt et al. | 430/109 |
| 4,870,164 | A | 9/1989 | Kühne et al. | 534/742 |
| 4,921,771 | A | 5/1990 | Tomono et al. | 430/110 |
| 4,935,502 | A | 6/1990 | Kühne et al. | 543/742 |
| 4,988,598 | A | 1/1991 | Tomono et al. | 430/99 |
| 4,997,739 | A | 3/1991 | Tomono et al. | 430/110 |
| 5,004,666 | A | 4/1991 | Tomono et al. | 430/110 |
| 5,023,158 | A | 6/1991 | Tomono et al. | 430/99 |
| 5,032,483 | A | 7/1991 | Ichimura et al. | 430/106 |
| 5,384,224 | A | 1/1995 | Tanikawa et al. | 430/106 |
| 5,547,800 | A | 8/1996 | Nishimori et al. | 430/110 |
| 5,578,408 | A | 11/1996 | Kohtaki et al. | 430/106.6 |
| 5,629,118 | A | 5/1997 | Tomono et al. | 430/99 |
| 5,629,123 | A | 5/1997 | Tomono et al. | 430/110 |
| 5,707,769 | A * | 1/1998 | Hagi et al. | 430/45 |
| 5,707,771 | A | 1/1998 | Matsunaga | 430/110 |
| 5,712,068 | A | 1/1998 | Dalal et al. | 430/106 |
| 5,744,276 | A | 4/1998 | Ohno et al. | 430/109 |
| 5,811,213 | A | 9/1998 | Chiba | 430/108.1 |
| 5,942,366 | A | 8/1999 | Ohno et al. | 430/125 |
| 5,955,234 | A | 9/1999 | Matsunaga et al. | 430/110 |
| 6,028,178 | A | 2/2000 | Metz et al. | 543/581 |
| 6,066,422 | A * | 5/2000 | Blaszak et al. | 430/45 |
| 6,117,605 | A | 9/2000 | Chiba | 430/108.21 |
| 6,159,647 | A * | 12/2000 | Anno et al. | 430/45 |
| 6,168,895 | B1 | 1/2001 | Metz et al. | 430/106 |
| 6,221,548 | B1 | 4/2001 | Shiba et al. | 430/106 |

FOREIGN PATENT DOCUMENTS

| | | |
|---|---|---|
| EP | 0 827 039 | 3/1998 |
| EP | 0 890 883 | 1/1999 |
| GB | 2159972 | 12/1985 |
| JP | 49-27228 | 3/1974 |
| JP | 50-62442 | 5/1975 |
| JP | 52-3305 | 1/1977 |
| JP | 52-3304 | 12/1977 |
| JP | 57-52574 | 3/1982 |
| JP | 57-54954 | 4/1982 |
| JP | 61-7844 | 1/1986 |
| JP | 62-280779 | 12/1987 |
| JP | 62-291669 | 12/1987 |
| JP | 1-9466 | 1/1989 |
| JP | 1-142559 | 6/1989 |
| JP | 1-154161 | 6/1989 |
| JP | 1-185660 | 7/1989 |
| JP | 1-185661 | 7/1989 |
| JP | 1-185662 | 7/1989 |
| JP | 1-185663 | 7/1989 |
| JP | 1-238672 | 9/1989 |
| JP | 2-87160 | 3/1990 |
| JP | 2-096181 | 4/1990 |
| JP | 2-37949 | 8/1990 |
| JP | 2-196247 | 8/1990 |
| JP | 2-207273 | 8/1990 |
| JP | 2-207274 | 8/1990 |

(Continued)

OTHER PUBLICATIONS

Derwent Patent Abstracts WPI 002 509 392 for JP 63-18628 (1988).

*Primary Examiner*—John L Goodrow
(74) *Attorney, Agent, or Firm*—Fitzpatrick, Cella, Harper & Scinto

(57) ABSTRACT

A yellow toner in which, in a spectral-distribution diagram in which the reflectance (%) is plotted as ordinate and the. wavelength (nm) as abscissa, the reflectance determined for a toner in a state of powder ranges from 15% to 20% at a wavelength of 500 nm and ranges from 75% to 80% at a wavelength of 600 nm, a cyan toner in which, in the like spectral-distribution diagram, the reflectance determined for a toner in a state of powder ranges from 30% to 35% at a wavelength of 450 nm and ranges from 35% to 40% at a wavelength of 475 nm, and a magenta toner in which, in the like spectral-distribution diagram, the reflectance determined for a toner in a state of powder ranges from 5% to 10% at a wavelength of 425 nm and ranges from 65% to 70% at a wavelength of 675 nm. These color toners each contain corresponding pigments in specific combination, and promise color reproduction which can ensure the color tones of process inks.

6 Claims, 1 Drawing Sheet

FOREIGN PATENT DOCUMENTS

| | | |
|---|---|---|
| JP | 2-208662 | 8/1990 |
| JP | 2-213854 | 8/1990 |
| JP | 3-2764 | 1/1991 |
| JP | 3-276163 | 12/1991 |
| JP | 4-107467 | 4/1992 |
| JP | 4-149559 | 5/1992 |
| JP | 4-301853 | 10/1992 |
| JP | 5-61238 | 3/1993 |
| JP | 5-249735 | 9/1993 |
| JP | 6-230607 | 8/1994 |
| JP | 6-266163 | 9/1994 |
| JP | 7-92737 | 4/1995 |
| JP | 7-234542 | 9/1995 |
| JP | 7-295298 | 11/1995 |
| JP | 8-36275 | 2/1996 |
| JP | 8-54750 | 2/1996 |
| JP | 8-209017 | 8/1996 |
| JP | 8-234480 | 9/1996 |
| JP | 8-262799 | 10/1996 |
| JP | 8-278662 | 10/1996 |
| JP | 2632423 | 7/1997 |
| JP | 10-171156 | 6/1998 |
| JP | 11-84716 | 3/1999 |
| JP | 11-160912 | 6/1999 |
| JP | 11-249377 | 9/1999 |
| JP | 2001-5221 | 1/2001 |
| JP | 2001-117278 | 4/2001 |
| JP | 2001-154412 | 6/2001 |

* cited by examiner

COLOR TONER, AND FULL-COLOR IMAGE FORMING METHOD

This application is a division of application Ser. No. 10/345,483 filed Jan. 17, 2003, the entire disclosure of which is incorporated herein by reference.

BACKGROUND OF THE INVENTION

1. Field of the Invention

This invention relates to color toners used in the development of electrostatic latent images or in a toner jet system. More particularly, this invention relates to a cyan toner, a magenta toner and a yellow toner which exhibit color reproduction ranges matched to overhead projector (OHP) projection tones having a high chroma and a high transparency and to color tones of process inks even when using heat-and-pressure fixing means in which any oil for preventing high-temperature offset is not used or such an oil is used in a small quantity; and a full-color image-forming method making use of these toners.

2. Related Background Art

In recent years, in proposed full-color copying machines there is commonly used a method in which, using four photosensitive members and one beltlike transfer member, electrostatic latent images formed respectively on the photosensitive members are developed with a cyan toner, a magenta toner, a yellow toner and a black toner to form corresponding toner images and then a transfer medium is so transported as to be held between the photosensitive members and the beltlike transfer member to transfer the toner images in straight pass, followed by fixing to form a full-color image, and a method in which the transfer medium is wound around the surface of a cylindrical transfer member set opposite to a photosensitive member, by the aid of electrostatic force or mechanical action of a gripper or the like, and the steps of development and transfer are carried out four times, followed by fixing to form a full-color image.

As toners used in such full-color copying machines, the toners are required to be well color-mixed in the step of heat-and-pressure fixing, without damaging any color reproducibility and any transparency of overhead projector (OHP) images. Compared with ordinary toners for black-and-white copying machines, toners for full-color images may preferably make use of low-molecular-weight binder resins having sharp-melt properties. However, usually, the use of such binder resins having sharp-melt properties tends to cause a problem on high-temperature anti-offset properties because of a low self-agglomerative force of the binder resins when the toners melt in the step of heat-and-pressure fixing. In ordinary toners for black-and-white copying machines, relatively highly crystalline waxes as typified by polyethylene wax and polypropylene wax are used as release agents in order to improve high-temperature anti-offset properties. For example, these are disclosed in Japanese Patent Publication Nos. 52-3304 and 52-3305 (Japanese Patent Application Laid-Open Nos. 49-065231 and 49-065232) and Japanese Patent Application Laid-Open No. 57-52574. In the toners for full-color images, such release agents may inhibit transparency when images are projected by an OHP, because of their own high crystallizability and a difference in refractive index of the materials of PH sheets, so that the projected images may have low chroma and lightness.

To solve such a problem, toners having a specific storage elastic modulus are proposed.

For example, Japanese Patent Application Laid-Open Nos. 11-84716 and 8-54750 disclose toners having a specific storage elastic modulus at 180° C. or 170° C. However, as for color toners required to have both low-temperature fixing performance and high-temperature anti-offset properties, to have a good fixing performance in the heat-and-pressure fixing means in which any oil for preventing high-temperature offset is not used or such an oil is used in a small quantity, and to have a sufficient color mixing performance, the toners may have too low viscosity and also have not been satisfactory in respect of storage stability in a high-temperature environment.

Japanese Patent Application Laid-Open Nos. 5-249735, 7-92737, 7-234542, 7-295298, 8-234480, 8-278662 and 10-171156 also disclose toners having specific storage elastic moduli. However, in order to attain fixing performance, storage stability and OHP transparency which are ideal for color toners, there has been room for improvement.

To solve the above problem, as disclosed in Japanese Patent Application Laid-Open Nos. 4-149559 and 4-107467, a method is proposed in which a nucleating agent is used in combination with a wax so as to lower the crystallizability of the wax. As also disclosed in Japanese Patent Application Laid-Open Nos. 4-301853 and 5-61238, a method is proposed in which a wax having a low crystallinity is used. As waxes having a relatively good transparency and a low melting point, montan type waxes are available. The use of montan type waxes is disclosed in Japanese Patent Application Laid-Open Nos. 1-185660, 1-185661, 1-185662, 1-185663 and 1-238672. These waxes, however, by no means satisfy all the transparency in OHP and the low-temperature fixing. performance and high-temperature anti-offset properties at the time of heat-and-pressure fixing.

Accordingly, in usual color toners, an oil such as silicone oil or fluorine oil is applied to heat fixing rollers without adding any release agent as far as possible, so as to achieve an improvement in high-temperature anti-offset properties and OHP transparency. However, fixed images thus obtained have excess oil having adhered to their surfaces. This oil may adhere to photosensitive members to cause contamination or the oil may swell fixing rollers to shorten the lifetime of the fixing rollers. In order not to cause any oil streaks on the fixed images, it is necessary to feed oil onto the fixing roller surface evenly and in a constant quantity. This tends to require fixing assemblies having a large size.

Accordingly, in the heat-and-pressure fixing means in which any oil is not used or the oil is used in a small quantity, it is long-awaited to provide a toner having kept offset from occurring and also promising superior transparency of fixed images.

Meanwhile, with an increase in cases in which color copying machines are connected to computers via controllers and used as high-grade color printers, a color management system has come to be proposed which makes color control of the whole system. As a result, specific users have come to strongly demand that the printed images produced by a color printer of an electrophotographic system are identical in tinges with the printed images produced by printing making use of process inks. Thus, there has been a demand for a cyan toner, a magenta toner and a yellow toner which have the same color tones as process inks, and for an image-forming method making use of them.

Some proposals have ever been made on pigments for cyan toners, and known various dyes and pigments exhibiting cyan chromatic color are in wide use, such as C.I. Pigment Blue 15:3, do. 15:4, C.I. Solvent Blue 25, do. 35, do. 68, do. 70 and do. 111.

Meanwhile, in the case of full-color images, colors are reproduced using three chromatic toners consisting of three-primary-color coloring materials, a yellow toner, a magenta toner and a cyan toner, or four color toners consisting of these toners and a black toner added thereto. In order to obtain images having the intended color tones, the balancing with different colors is important, and it is proposed to use the same-color pigments or dyes in combination or to use different-color pigments and/or dyes in combination in order to slightly change the color tone of the cyan toner. For example, Japanese Patent Publication No. 50-777 (Japanese Patent Application No. 47-083365) proposes the use of a cyan pigment and a yellow pigment in combination; Japanese Patent Application Laid-Open No. 61-7844, the use of a cyan pigment and the same-color dye in combination; and Japanese Patent Application Laid-Open No. 62-280779, the use of a cyan pigment and a magenta pigment in combination.

Japanese Patent Application Laid-Open No. 3-276163 also discloses the use of C.I. Pigment Blue 15:3 and C.I. Pigment Green 7 in combination. It, however, does not refer to any ratio of both pigments. Japanese Patent Application Laid-Open No. 2001-5221 still also discloses the use of C.I. Pigment Blue 15:3 and C.I. Pigment Green 36 in combination. The C.I. Pigment Green 36, however, has been replaced with Br, and has had unsatisfactory charge maintenance performance and environmental stability. With regard to fixing performance, too, it has been found necessary to make further improvement. It, however, has been found that a charge control agent is limited to a metal salt of a benzilic acid derivative, and has a drawback in charging stability and fixing performance, as compared with an aromatic carboxylic acid derivative selected from an aromatic oxycarboxylic acid and an aromatic alkoxycarboxylic acid, and a metal compound of the aromatic carboxylic acid derivative, which are described in the present invention.

Some proposals have also ever been made on pigments for magenta toners. In view of superior sharpness and transparency of color and also superior light-fastness, quinacridone pigments have been in wide use.

For example, Japanese Patent Application Laid-Open Nos. 49-27228, 57-54954 and 1-142559 disclose a toner making use of 2,9-dimethdylquinacridone alone. This toner certainly has a superior light-fastness, but cannot be said to be a sufficiently vivid magenta toner. Japanese Patent Application Laid-Open No. 64-9466 discloses that a quinacridone pigment and a xanthene dye or a pigment obtained by making a xanthene dye into a lake are used in combination so as to improve the vividness of toners. This toner has not attained a sufficient vividness, and has had such a problem that it changes in color and images formed may change in color when left standing over a long time.

Japanese Patent Application Laid-Open No. 1-154161 discloses the use of a quinacridone pigment of 0.5 μm or smaller average particle diameter in an attempt to improve the transparency of magenta toners. The transparency of toners depends on pigments, resins and how and to what extent the pigments are dispersed in resins, and any magenta toners having a high transparency have not necessarily been obtained.

Meanwhile, in the case of full-color images, colors are reproduced using three chromatic toners consisting of three-primary-color coloring materials, a yellow toner, a magenta toner and a cyan toner, or four color toners consisting of these toners and a black toner added thereto. In order to obtain images having the intended color tones, the balancing with different colors is important, and it is also attempted to slightly change the color tone of the magenta toner.

For example, Japanese Patent Publication No. 63-18628 (Japanese Patent Application Laid-Open No. 55-048250 discloses a mixture of compounds which contains two types of substituted quinacridones. Japanese Patent Application Laid-Open No. 62-291669 discloses the use of a mixed crystal of 2,9-dimethylquinacridone and unsubstituted quinacridone as a magenta colorant, which is proposed as a colorant having the intended hue and also aiming at an improvement in triboelectric charging performance of toners.

Its color tone has more shifted toward a tinge of yellow as a whole than the case of the use of only 2,9-dimethylquinacridone. However, it is blue-tinged as compared with the hue of magenta inks for offset printing. Thus, there have remained many points to be improved.

Nowadays, as colorants for yellow toners, a large number of colorants are known in the present technical field. For example, as dyes, Japanese Patent Application Laid-Open No. 2-207273 discloses C.I. Solvent Yellow 112; Japanese Patent Application Laid-Open No. 2-207274, C.I. Solvent Yellow 160; and Japanese Patent Application Laid-Open No. 8-36275, C.I. Solvent Yellow 162. As pigments, Japanese Patent Application Laid-Open No. 50-62442 discloses a benzidine type yellow pigment; Japanese Patent Application Laid-Open No. 2-87160, a monoazo type yellow pigment; and Japanese Patent Application Laid-Open No. 2-208662, C.I. Pigment Yellow 120, 151, 154 and 156.

However, colorants for yellow toners conventionally known have had various problems. For example, although dye type colorants commonly have superior transparency, they are inferior in light-fastness, and have a problem in storage stability of images.

Meanwhile, although the above group of pigments have light-fastness superior to that of dyes, they have still a problem in light-fastness, compared with, e.g., quinacridone pigments used for magenta toners or copper phthalocyanine pigments used for cyan toners. There has arisen such a problem that they discolor or conspicuously change in hue in a long-time light exposure test.

In addition, although yellow pigments having superior light-fastness and heat resistance are also available besides the foregoing, they have so strong hiding power as to result in an extremely low transparency, and are unsuitable for full-color image formation.

Japanese Patent Application Laid-Open No. 2-37949 refers to a disazo compound having superior light-fastness and its production process. This is a group of compounds typified by C.I. Pigment Yellow 180, which is one of azo pigments not only having superior light-fastness and heat resistance but also meeting ecological demands.

Yellow toners making use of C.I. Pigment Yellow 180 alone is disclosed in Japanese Patent Application Laid-Open Nos. 6-230607, 6-266163 and 8-262799. Toners having these pigments, however, have a poor coloring power, and in addition can by no means be said to have good transparency. Thus, as their use for full-color image formation, it has been a matter of great urgency for them to be more improved.

Meanwhile, Japanese Patent Application Laid-Open No. 8-209017 discloses an electrophotographic toner in which, in order to solve the above problem, a pigment is made fine-particle to improve the specific surface area of the pigment to improve its transparency and coloring power. However, where the pigment classified as C.I. Pigment Yellow 180 is made fine-particle, it may insufficiently be dispersed in the binder resin included in the toner because of its unavoidably strong self-agglomerative properties. According to studies made by us, toners having pigments with poor dispersibility can hardly achieve charge stabilization and have caused problems of fog and toner scattering.

Japanese Patent No. 2632423 discloses toners produced by kneading and dispersing a group of condensation azo type yellow pigments in resins.

The above toner has achieved the sharpness and clearness of hues and also the improvement in transparency by kneading and dispersing slightly dispersible compounds in an average particle diameter of 0.2 μm or less. However, when viewed as yellow toners for forming highly minute full-color images, the level of pigment dispersibility does not still reach any aimed level. Further, in studies made by us, it is difficult to stabilize charge. Problems such as density decrease and fog have also arisen during extensive operation (running).

Meanwhile, in the case of full-color images, colors are reproduced using three chromatic toners consisting of three-primary-color coloring materials, a yellow toner, a magenta toner and a cyan toner, or four color toners consisting of these toners and a black toner added thereto. In order to obtain images having faithfully reproduced the color tones of process inks in the electrophotographic system and toner jet system, the balance with different colors is very important. Among color toners distributed at present in the market, the yellow toner has a tone most apart from the process inks in actuality. Accordingly, use in combination with a pigment or dye more yellow-tinged than conventional yellow pigments should have been proposed. However, no invention having such an object has ever been found. Also, in that case, taking into account the balancing with cyan color, the reproduction of green color becomes weak. Hence, in a sense of its compensation, use in combination with a pigment or dye more green-tinged than conventional cyan pigments should have been proposed. However, no invention having such an object has ever been found. Also, in that case, making the color tone of magenta constant certainly brings about a great improvement in the reproducibility of red color, but conversely results in a poor reproducibility of blue color. Hence, it is necessary to delicately adjust the color tone of magenta pigments, and use in combination with a pigment or dye achievable of such an object should have been proposed. However, no invention having such an object has ever been found.

SUMMARY OF THE INVENTION

An object of the present invention is to provide a yellow toner, a cyan toner and a magenta toner which have solved the above problems.

More specifically, with regard to the yellow toner, an object of the present invention is to provide a yellow toner which can cover the yellow color tone in process inks by using a specific pigment in combination, and to provide a yellow toner having coloring power high enough to cover a dynamic range of from low density to high density, having high chroma and brightness, having superior OHP transparency and having high light-fastness.

Another object of the present invention is to provide a yellow toner which can ensure a broad fixing temperature region and has superior low-temperature fixing performance even when the heat-and-pressure fixing means is used in which any oil for preventing high-temperature offset is not used or such an oil is used in a small quantity.

Still another object of the present invention is to provide a yellow toner having superior storage stability, heat resistance and anti-blocking properties.

A further object of the present invention is to provide a yellow toner exhibiting good fixing performance and color mixing performance, having sufficient triboelectric charging performance, having high glossiness which makes image quality higher, enabling sufficient prevention of high-temperature offset, having broad fixable temperature, free from any toner melt adhesion to the interior of a developing assembly, i.e., to its components such as a sleeve, a blade and a coating roller, further ensuring good cleaning performance, and not causative of any filming to a photosensitive member.

A still further object of the present invention is to provide a yellow toner free from any fog, having superior solid uniformity, and having superior running stability.

With regard to the cyan toner, an object of the present invention is to provide a cyan toner which can cover the cyan color tone in process inks by using a specific pigment in combination, and to provide a cyan toner having coloring power high enough to cover a dynamic range of from low density to high density, having high chroma and brightness, having superior OHP transparency and having high light-fastness.

Another object of the present invention is to provide a cyan toner which can ensure a broad fixing temperature region and has superior low-temperature fixing performance even when the heat-and-pressure fixing means is used in which any oil for preventing high-temperature offset is not used or such an oil is used in a small quantity.

Still another object of the present invention is to provide a cyan toner having superior storage stability, heat resistance and anti-blocking properties.

A further object of the present invention is to provide a cyan toner exhibiting good fixing performance and color mixing performance, having sufficient triboelectric charging performance, having high glossiness which makes image quality higher, enabling sufficient prevention of high-temperature offset, having broad fixable temperature, free from any toner melt adhesion to the interior of a developing assembly, i.e., to its components such as a sleeve, a blade and a coating roller, further ensuring good cleaning performance, and not causative of any filming to a photosensitive member.

A still further object of the present invention is to provide a cyan toner free from any fog, having superior solid uniformity, and having superior running stability.

With regard to the magenta toner, an object of the present invention is to provide a magenta toner which can cover the magenta color tone in process inks by using a specific pigment in combination, and to provide a magenta toner having coloring power high enough to cover a dynamic range of from low density to high density, having high chroma and brightness, having superior OHP transparency and having high light-fastness.

Another object of the present invention is to provide a magenta toner which can ensure a broad fixing temperature region and has superior low-temperature fixing performance even when the heat-and-pressure fixing means is used in which any oil for preventing high-temperature offset is not used or such an oil is used in a small quantity.

Still another object of the present invention is to provide a magenta toner having superior storage stability, heat resistance and anti-blocking properties.

A further object of the present invention is to provide a magenta toner exhibiting good fixing performance and color mixing performance, having sufficient triboelectric charging performance, having high glossiness which makes image quality higher, enabling sufficient prevention of high-temperature offset, having broad fixable temperature, free from any toner melt adhesion to the interior of a developing assembly,. i.e., to its components such as a sleeve, a blade and a coating roller, further ensuring good cleaning performance, and not causative of any filming to a photosensitive member.

A still further object of the present invention is to provide a magenta toner free from any fog, having superior solid uniformity, and having superior running stability.

A still further object of the present invention is to provide a color toner kit, and an electrophotographic full-color image-forming method, which can ensure the color tones (color reproduction range) of process inks by using the yellow toner, the cyan toner, the magenta toner and a black toner.

To achieve the above objects, the present invention provides a yellow toner containing at least a binder resin and a colorant, wherein;

in a spectral-distribution diagram in which the reflectance (%) is plotted as ordinate and the wavelength (nm) as abscissa, the reflectance determined for a toner in a state of powder ranges from 15% to 20% at a wavelength of 500 nm and ranges from 75% to 80% at a wavelength of 600 nm.

The present invention also provides a cyan toner containing at least a binder resin and a colorant, wherein;

in a spectral-distribution diagram in which the reflectance (%) is plotted as ordinate and the wavelength (nm) as abscissa, the reflectance determined for a toner in a state of powder ranges from 30% to 35% at a wavelength of 450 nm and ranges from 35% to 40% at a wavelength of 475 nm.

The present invention still also provides a. magenta toner containing at least a binder resin and a colorant, wherein;

in a spectral-distribution diagram in which the reflectance (%) is plotted as ordinate and the wavelength (nm) as abscissa, the reflectance determined for a toner in a state of powder ranges from 5% to 10% at a wavelength of 425 nm and ranges from 65% to 70% at a wavelength of 675 nm.

The present invention further provides a color toner kit used in a full-color image-forming method, having a yellow toner, a cyan toner and a magenta toner, wherein;

the yellow toner is a yellow toner in which, in a spectral-distribution diagram in which the reflectance (%) is plotted as ordinate and the wavelength (nm) as abscissa, the reflectance determined for a toner in a state of powder ranges from 15% to 20% at a wavelength of 500 nm and ranges from 75% to 80% at a wavelength of 600 nm;

the cyan toner is a cyan toner in which, in a spectral-distribution diagram in which the reflectance (%) is plotted as ordinate and the wavelength (nm) as abscissa, the reflectance determined for a toner in a state of powder ranges from 30% to 35% at a wavelength of 450 nm and ranges from 35% to 40% at a wavelength of 475 nm; and the magenta toner is a magenta toner in which, in a spectral-distribution diagram in which the reflectance (%) is plotted as ordinate and the wavelength (nm) as abscissa, the reflectance determined for a toner in a state of powder ranges from 5% to 10% at a wavelength of 425 nm and ranges from 65% to 70% at a wavelength of 675 nm.

The present invention still further provides a full-color image-forming method comprising the steps of passing a recording material having thereon at least a yellow toner image, a cyan toner image and a magenta toner image through a heat-and-pressure fixing means, heat-and-pressure fixing the yellow toner image, the cyan toner image and the magenta toner image onto the recording material, and forming a full-color image on the recording material, wherein;

the yellow toner image is formed using a yellow toner in which, in a spectral-distribution diagram in which the reflectance (%) is plotted as ordinate and the wavelength (nm) as abscissa, the reflectance determined for a toner in a state of powder ranges from 15% to 20% at a wavelength of 500 nm and ranges from 75% to 80% at a wavelength of 600 nm;

the cyan toner image is formed using a cyan toner in which, in a spectral-distribution diagram in which the reflectance (%) is plotted as ordinate and the wavelength (nm) as abscissa, the reflectance determined for a toner in a state of powder ranges from 30% to 35% at a wavelength of 450 nm and ranges from 35% to 40% at a wavelength of 475 nm; and the magenta toner image is formed using a magenta toner in which, in a spectral-distribution diagram in which the reflectance (%) is plotted as ordinate and the wavelength (nm) as abscissa, the reflectance determined for a toner in a state of powder ranges from 5% to 10% at a wavelength of 425 nm and ranges from 65% to 70% at a wavelength of 675 nm.

DESCRIPTION OF THE PREFERRED EMBODIMENTS

Figure 1:
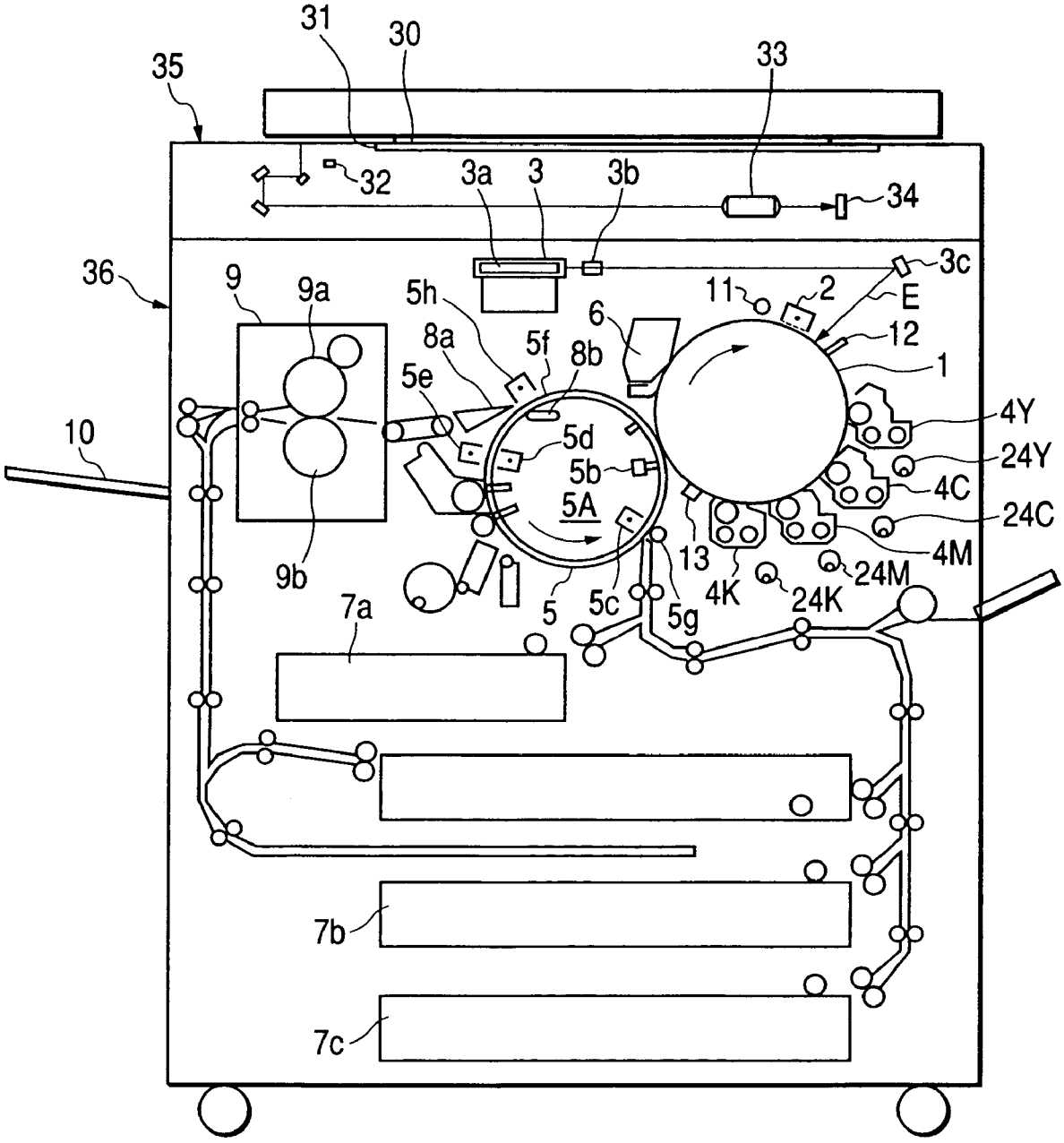
FIG. 1 is a schematic drawing illustrating an image forming apparatus used in an image forming method in accordance with an embodiment of the present invention.

The yellow toner, cyan toner and magenta toner of the present invention each contains at least a binder resin and a colorant.

As the colorants according to the present invention, compounds of (1), (3) to (5) groups are used whose structures are shown below first. Yellow toner colorant: (Compound (1) group)

(1-1)

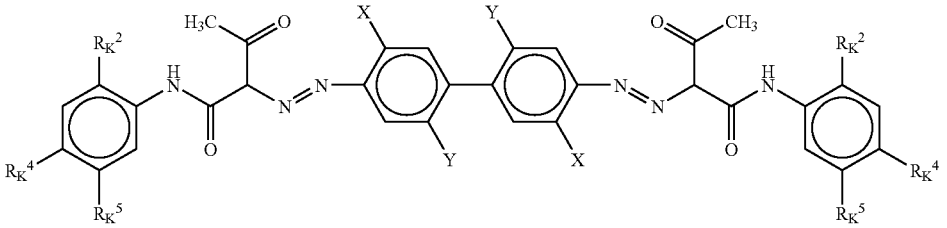

wherein X represents Cl, $CH_3$ or $OCH_3$; Y represents H or Cl; $R_K^2$ represents H, $CH_3$, $OCH_3$ or Cl; $R_K^4$ represents H, $CH_3$, Cl, $OCH_3$ or $OC_2H_5$; and $R_K^5$ represents $OCH_3$ or Cl.

(1-2)

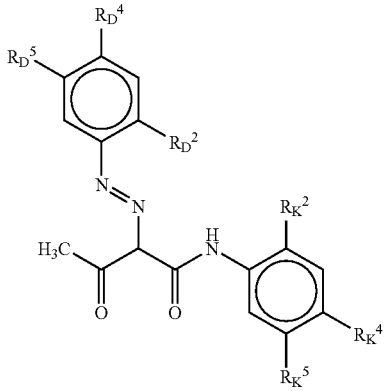

wherein $R_D^2$ represents $NO_2$, $CH_3$, $OCH_3$ or Cl; $R_D^4$ represents $CH_3$, Cl, H, $OCH_3$ or $NO_2$; $R_D^5$ represents H or $OCH_3$; $R_K^2$ represents H, $CH_3$, Cl or $OCH_3$; $R_K^4$ represents H, $CH_3$, Cl, $OC_2H_5$ or $NHCOCH_3$; and $R_K^5$ represents $HOCH_3$ or Cl.

(1-3)

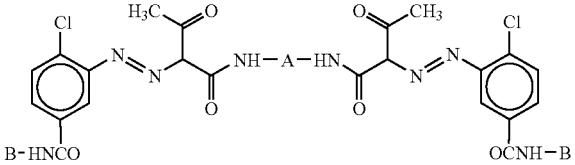

wherein

A represents

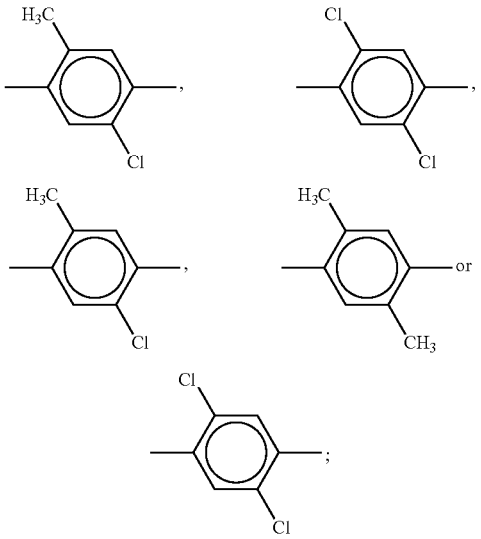

and B represents

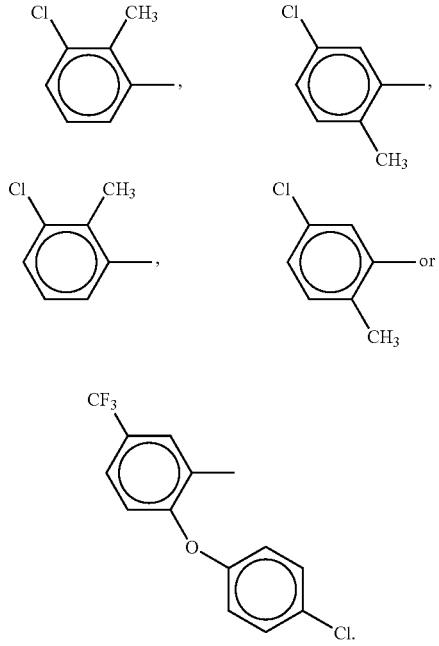

(1-4)

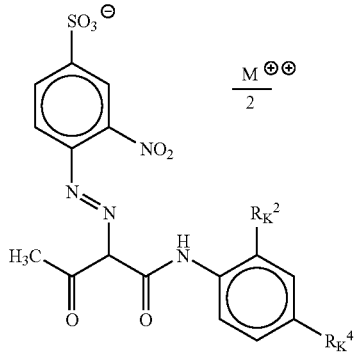

wherein $R_K^2$ represents H, $CH_3$ or Cl; $R_K^4$ represents H or $OCH_3$; and M represents Ca or Sr.

Cyan toner colorants: (Compound (3), (4) groups)

(3-1)

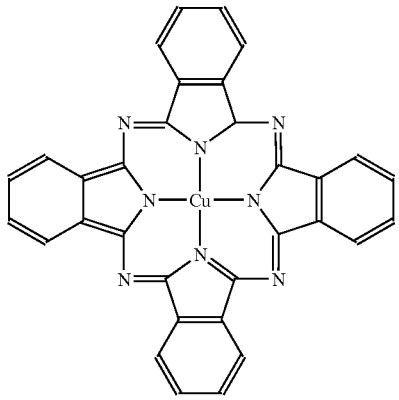

-continued (4-1)

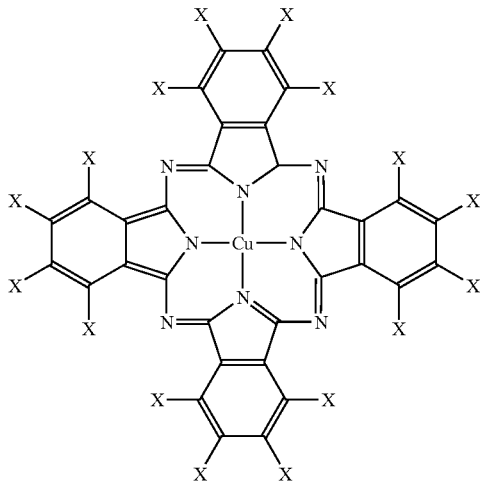

wherein X represents Cl or Br.

Magenta toner colorants: (Compound (5) group)

(5-1)

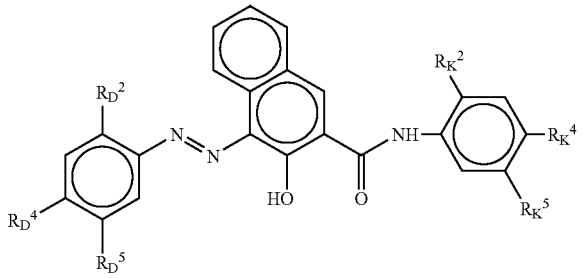

wherein $R_D^2$ represents H or $OCH_3$; $R_D^4$ represents H $CONH_2$;. $R_D^5$ represents H, $SO_2N(C_2H_5)_2$, $CONHC_6H_5$, $CONHC_6H_5$, $CONH_2$ or $CONHC_6H_4$-(p)$CONH_2$; $R_K^2$ represents H, $OCH_3$, $CH_3$ or $OC_2H_5$; $R_K^4$ represents H, $OCH_3$ or Cl; and $R_K^5$ represents H, $OCH_3$, Cl or $NO_2$.

(5-2)

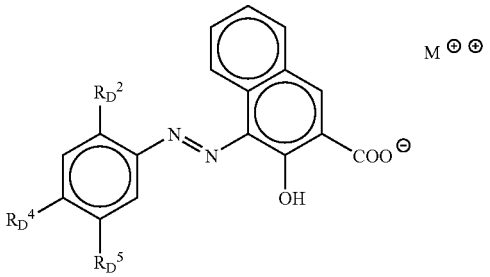

wherein $R_D^2$ represents H or $SO_3^-$; $R_D^4$ represents H, Cl or $CH_3$; $R_D^5$ represents H, Cl, $CH_3$, $C_2H_5$ or $SO_3^-$; and M represents Ba, Ca, Sr, Mn or Mg; provided that one of $R_D^2$ and $R_D^5$ is $SO_3^-$.

(5-3)

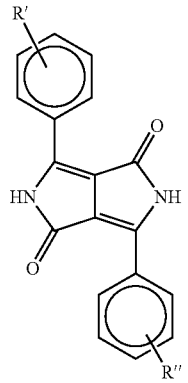

wherein R' represents H, $CH_3$, $CF_3$, Cl, Br or $N(CH_3)_2$; and R" represents $CH_3$ or $C_2H_5$).

The pigments used in the yellow toner, cyan toner and magenta toner of the present invention are described below.

As colorants of the yellow toner of the present invention, it is preferable that;

a compound selected from the compound (1) group and a compound selected from the compound (2) group consisting of C.I. Pigment Yellow 110, 139 and 147 are mixed in a weight ratio of from 70:30 to 99:1, and the compounds selected from each of the compound (1) group and the compound (2) are contained in an amount of from 5 to 15 parts by weight in total, based on 100 parts by weight of the binder resin; and in the yellow toner, in its spectral-distribution diagram in which the reflectance (%) is plotted as ordinate and the wavelength (nm) as abscissa, the reflectance determined as that of a toner kept in the state of powder ranges from 15% to 20% at a wavelength of 500 nm and ranges from 75% to 80% at a wavelength of 600 nm.

If the reflectance at a wavelength of 500 nm is less than 15% or the reflectance at a wavelength of 600 nm is less than 75%, reproduced images may be so red-tinged (the value a* shifts to the plus side) that the red can well be reproduced but conversely the reproducibility of green may be damaged.

If on the other hand the reflectance at a wavelength of 500 nm is more than 20% or the reflectance at a wavelength of 600 nm is more than 80%, reproduced images may be so red-tinged (the value a* shifts to the plus side) that the red can well be reproduced but conversely the reproducibility of green may be damaged.

Namely, an average color tone (commonly called Japan color) of process inks can faithfully be reproduced when the reflectance determined as that of a toner kept in the state of powder ranges from 15% to 20% at a wavelength of 500 nm and ranges from 75% to 80% at a wavelength of 600 nm.

In that case, the compound shown in the compound (1) group may preferably be a pigment selected from C.I. Pigment Yellow 155, 17, 74, 97, 93, 62 and 168, and the compound shown in the compound (2) group may preferably be a pigment selected from C.I. Pigment Yellow 110, 139 and 147. As a result of extensive studies, a more preferable combination is a system of use of two pigments C.I. Pigment Yellow 155 and C.I. Pigment Yellow 147 in combination.

The compounds selected from each of the compound (1) group and the compound (2) may preferably be contained in an amount of from 5 to 15 parts by weight in total, based on 100 parts by weight of the binder resin. If they are contained in an amount of less than 5 parts by weight in total, the coloring power of the toner may be lowered. If so, high-grade images with high image density may be difficult to obtain while the dispersibility of the pigment is improved. If they are in an amount of more than 15 parts by weight, the toner may have a low transparency, resulting in a low transparency of images formed on transparency films. In addition, the reproducibility of a neutral tint as typified by human flesh tint may lower. Moreover, the toner may also have an unstable charging performance to cause problems of fog in a low-temperature and low-humidity environment and toner scattering in a high-temperature and high-humidity environment.

The compounds selected from each of the compound (1) group and the compound (2) both have superior dispersibility, may not liberate from toner particle surfaces, and may not cause any problems of fog, drum contamination, faulty cleaning and so forth. In addition, when the toner is blended with a carrier and used as a two-component developer, they can show stable charging performance in long-term extensive operation (running) without causing the problem of carrier contamination. They also may not cause problems of a lowering of transparency and non-uniformity of charge quantity distribution caused by using the compounds selected from each of the compound (1) group and the compound (2) in combination.

As colorants of the cyan toner of the present invention, it is preferable that the compounds selected from each of the compound (3) group and the compound (4) group are mixed in a weight ratio of from 90:10 to 99:1, and the compounds selected from each of the compound (3) group and the compound (4) group are contained in an amount of from 3 to 8 parts by weight in total, based on 100 parts by weight of the binder resin; and in the cyan toner, in its spectral-distribution diagram in which the reflectance (%) is plotted as ordinate and the wavelength (nm) as abscissa, the reflectance determined as that of a toner kept in a state of powder ranges from 30% to 35% at a wavelength of 450 nm and ranges from 35% to 40% at a wavelength of 475 nm.

In that case, a compound shown in the compound (3) group may preferably be selected from C.I. Pigment Blue 15:3 and 15:4, and a compound shown in the compound (4) group may preferably be C.I. Pigment Green 7.

If the reflectance at a wavelength of 450 nm is less than 30% or the reflectance at a wavelength of 475 nm is less than 30%, reproduced images may be so green-tinged (the value a* shifts to the minus side) that the green can well be reproduced, but conversely the reproducibility of blue may be damaged.

If on the other hand the reflectance at a wavelength of 450 nm is more than 35% or the reflectance at a wavelength of 475 nm is more than 40%, reproduced images may be so blue-tinged (the value a* shifts to the plus side) that the blue can well be reproduced, but conversely the reproducibility of green may be damaged.

Namely, an average color tone (commonly called Japan color) of process inks can faithfully be reproduced when the reflectance determined as that of a toner kept in a state of powder ranges from 30% to 35% at a wavelength of 450 nm and ranges from 35% to 40% at a wavelength of 475 nm.

In that case, the compound shown in the compound (3) group may preferably be a pigment selected from C.I. Pigment Blue 15:3 and 15:4, and the compound shown in the compound (4) group may preferably be a pigment selected from C.I. Pigment Green 7. As a result of extensive studies, a more preferable combination is a system of the use of two pigments C.I. Pigment Blue 15:3 and C.I. Pigment Green 7 in combination.

The compounds selected from each of the compound (3) group and the compound (4) group may preferably be contained in an amount of from 3 to 8 parts by weight in total, based on 100 parts by weight of the binder resin. If they are contained in an amount of less than 3 parts by weight in total, the coloring power of the toner may be lowered. If so, any high-grade images with high image density may be difficult to obtain while the dispersibility of the pigment is improved. If they are in an amount of more than 8 parts by weight, the toner may have a low transparency, resulting in a low transparency of images formed on transparency films. In addition, the reproducibility of a neutral tint may lower. Moreover, the toner may also have an unstable charging performance to cause problems of fog in a low-temperature and low-humidity environment and toner scattering in a high-temperature and high-humidity environment.

The compounds selected from each of the compound (3) group and the compound (4) both have superior dispersibility, may not be liberated from toner particle surfaces, and may not cause any problems of fog, drum contamination, faulty cleaning and so forth. In addition, also when the toner is blended with a carrier and used as a two-component developer, they can show stable charging performance in long-term extensive operation (running) without causing the problem of carrier contamination. They also may not cause problems of a lowering of transparency and non-uniformity of charge quantity distribution caused by using the compounds selected from each of the compound (3) group and the compound (4) in combination.

As colorants of the magenta toner of the present invention, it is preferable that a compound selected from the compound (5) group and C.I. Pigment Red 122 are mixed in a weight ratio of from 70:30 to 99:1, and the compound of the compound (5) group and C.I. Pigment Red 122 are contained in an amount of from 4 to 10 parts by weight in total, based on 100 parts by weight of the binder resin; and in the magenta toner, in its spectral-distribution diagram in which the reflectance (%) is plotted as ordinate and the wavelength (nm) as abscissa, the reflectance determined as that of a toner kept in a state of powder ranges from 5% to 10% at a wavelength of 425 nm and ranges from 65% to 70% at a wavelength of 675 nm.

In that case, the compound shown in the compound (5) group may preferably be selected from C.I. Pigment violet 19 and C.I. Pigment Red 5, 146, 238, 57:1 ad 254.

As a result of extensive studies, a more preferable combination is a system of the use of two pigments C.I. Pigment Red 57:1 and C.I. Pigment Red 122 in combination.

The compound selected from the compound (5) group and C.I. Pigment Red 122 may preferably be contained in an amount of from 4 to 10 parts by weight in total, based on 100 parts by weight of the binder resin. If they are contained in an amount of less than 4 parts by weight in total, the coloring power of the toner may be lowered. If so, high-grade images with high image density may be difficult to obtain while the dispersibility of the pigment is improved. If they are in an amount of more than 10 parts by weight, the toner may have a low transparency, resulting in a low transparency of images formed on transparency films. In addition, the reproducibility of a neutral tint as typified by human flesh tint may lower. Moreover, the toner may also have an unstable charging performance to cause problems of fog in a low-temperature and low-humidity environment and toner scattering in a high-temperature and high-humidity environment.

The compound selected from the compound (5) group and C.I. Pigment Red 122 both have superior dispersibility, may not be liberated from toner particle surfaces, and may not cause any problems of fog, drum contamination, faulty cleaning and so forth. In addition, also when the toner is blended with a carrier and used as a two-component developer, they can show stable charging performance in long-term extensive operation (running) without causing the problem of carrier contamination. They also may not cause problems of a lowering of transparency and a non-uniformity of charge quantity distribution caused by using of the compounds selected from each of the compound selected from the compound (5) group and C.I. Pigment Red 122 in combination.

The yellow toner, cyan toner and magenta toner of the present invention all also have so superior light-fastness that almost no changes in color may be seen also when an image sample is subjected to a long-term exposure test using a commercially available weatherometer substantially according to JIS K7102.

The color toner kit of the present invention is used in a full-color image-forming method, and has the yellow toner, cyan toner and magenta toner of the present invention.

The full-color image-forming method of the present invention uses the yellow toner, cyan toner and magenta toner of the present invention optionally together with a black toner, and has at least a heat-and-pressure fixing step in which any oil is not used or an oil is used in a small quantity.

The present invention is described below in detail on items common to the yellow toner, cyan toner and magenta toner (hereinafter often simply the "toner" or "color toner").

First, the toner of the present invention has a storage elastic modulus at a temperature of 80° C., $G'_{80}$, within the range of from $1\times10^6$ to $1\times10^8$ dN/m$^2$, and preferably from $1\times10^6$ to $5\times10^7$ dN/m$^2$, in order to improve its storage stability, heat resistance and anti-blocking properties in a high-temperature environment. If the toner has a storage elastic modulus $G'_{80}$ of less than $1\times10^6$ dN/m$^2$, it may have inferior storage stability, heat resistance and anti-blocking properties in a high-temperature environment, so that toner particles may coalesce one another to form large agglomerates of toner, undesirably. In recent years, copying machines and printers are being made high-speed for their output speed and being made compact in body size, and hence they have a tendency toward higher in-machine temperature. Accordingly, in order to stably obtain images with high minuteness and high image quality, it is important for toners to have sufficient storage stability, heat resistance and anti-blocking properties in a high-temperature environment. Also, if the toner has a storage elastic modulus $G'_{80}$ of more than $1\times10^8$ dN/m$^2$, it can have sufficient storage stability, heat resistance and anti-blocking properties, but may have no sufficient fixing performance at low-temperature, undesirably.

The toner may also have a loss intercept (tan δ) at a temperature of 140° C., of from 0.3 to 1.5 [−], and preferably from 0.3 to 1.0 [−], in order to achieve both sufficient fixing performance and sufficient high-temperature anti-offset properties and further in order to obtain images having uniform gloss. If the toner has a loss intercept (tan δ) of more than 1.5 [−], it cannot have any sufficient high-temperature anti-offset properties, undesirably. If on the other hand it has a loss intercept (tan δ) of less than 1.0 [−], the toner cannot sufficiently be fixed, resulting in a great lowering of its color developability.

The binder resin used in the toner of the present invention may preferably be a resin selected from any of (a) a polyester resin, (b) a hybrid resin having a polyester unit and a vinyl copolymer unit, (c) a mixture of the hybrid resin and a vinyl copolymer and (d) a mixture of the hybrid resin and the polyester resin, where in molecular weight distribution as measured by gel permeation chromatography (GPC) of the resin component, the binder resin may preferably have a main peak in the region of molecular weight of from 3,500 to 10,000 (main-peak molecular weight Mp), and preferably in the region of molecular weight of from 4,000 to 9,000, and have a ratio of Mw (weight-average molecular weight) and Mn (number-average molecular weight), Mw/Mn, of 5.0 or higher. If the binder resin has a main peak in the region of molecular weight of less than 3,500, the toner may have insufficient anti-offset properties. If on the other hand it has a main peak in the region of molecular weight of more than 10,000, the toner cannot have any sufficient low-temperature fixing performance and also may afford insufficient OHP transparency. If the toner has an Mw/Mn of less than 5.0, it may be impossible to attain good anti-offset properties.

In the case when a polyester resin is used as the binder resin, alcohols and carboxylic acids or carboxylic anhydrides or carboxylates may be used as material monomers. Stated specifically, as a dihydric alcohol component, it may include, e.g., bisphenol-A alkylene oxide addition products such as polyoxypropylene(2.2)-2,2-bis(4-hydroxyphenyl) propane, polyoxypropylene(3.3)-2,2-bis(4-hydroxyphenyl) propane, polyoxyethylene(2.0)-2,2-bis(4-hydroxyphenyl) propane, polyoxypropylene(2.0)-polyoxyethylene(2.0)-2,2-bis(4-hydroxyphenyl)propane and polyoxypropylene(6)-2,2-bis(4-hydroxyphenyl)propane; and ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, bisphenol A and hydrogenated bisphenol A.

As a trihydric or higher alcohol component, it may include, e.g., sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane and 1,3,5-trihydroxymethylbenzene.

As an acid component, it may include aromatic dicarboxylic acids such as phthalic acid and terephthalic acid, or anhydrides thereof; alkyldicarboxylic acids such as succinic acid, adipic acid, sebacic acid and azelaic acid, or anhydrides thereof; succinic acids substituted with an alkyl group having 6 to 12 carbon atoms, or anhydrides thereof; unsaturated dicarboxylic acids such as fumaric acid, maleic acid and citraconic acid, or anhydrides thereof.

In particular, a polyester resin having as a diol component a bisphenol derivative represented by the following Formula (6) and as an acid component a carboxylic acid comprised of a dibasic or higher carboxylic acid or an acid anhydride thereof or a lower alkyl ester thereof (e.g., fumaric acid, maleic acid, maleic anhydride, phthalic acid, terephthalic acid, trimellitic acid or pyromellitic acid), and obtained by polycondensation of these components is preferred because it affords a good charging performance for color toners.

Formula (6)

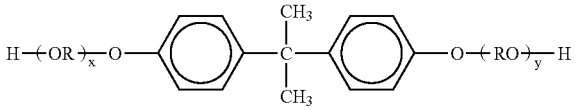

wherein R represents an ethylene group or a propylene group, x and y are each an integer of 1 or more, and an average value of x+y is 2 to 10;

In the case when the hybrid resin having a polyester unit and a vinyl copolymer unit is used as the binder resin, much better improvements in wax dispersion, low-temperature fixing performance and low-temperature fixing performance and anti-offset properties can be expected. The "hybrid resin" termed in the present invention refers to a resin in which vinyl copolymer units and polyester units have chemically been bonded. Stated specifically, it is formed by ester exchange reaction of a polyester unit with a vinyl copolymer unit made up by polymerizing a monomer having a carboxylate group such as acrylate or methacrylate, which may preferably form a graft copolymer (or block copolymer) comprised of vinyl copolymer units as the backbone polymer and the polyester units as the branch polymer.

As a vinyl monomer for forming the vinyl copolymer unit (vinyl resin), it may include the following: Styrene; styrene derivatives such as o-methylstyrene, m-methylstyrene, p-methylstyrene, α-methylstyrene, p-phenylstyrene, p-ethylstyrenee, 2,4-dimethylstyrene, p-n-butylstyrene, p-tert-butylstyrene, p-n-hexystyelene, p-n-octystyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene and p-nitrostyrene; ethylene unsaturated monoolefins such as ethylene, propylene, butylene and isobutylene; unsaturated polyenes such as butadiene and isoprene; vinyl halides such as vinyl chloride, vinylidene chloride, vinyl bromide and vinyl fluoride; vinyl esters such as vinyl acetate, vinyl propionate and vinyl benzoate; α-methylene aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; acrylic esters such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, 2-chloroethyl acrylate and phenyl acrylate; vinyl ethers such as methyl vinyl ether, ethyl vinyl ether and isobutyl vinyl ether; vinyl ketones such as methyl vinyl ketone, hexyl vinyl ketone and methyl isopropenyl ketone; N-vinyl compounds such as N-vinylpyrrole, N-vinylcarbazole, N-vinylindole and N-vinylpyrrolidone; vinylnaphthalenes; and acrylic acid or methacrylic acid derivatives such as acrylonitrile, methacrylonitrile and acrylamide.

It may further include monomers having carboxyl groups as exemplified by unsaturated dibasic acids such as maleic acid, citraconic acid, itaconic acid, alkenylsuccinic acids, fumaric acid and mesaconic acid; unsaturated dibasic acid anhydrides such as maleic anhydride, citraconic anhydride, itaconic anhydride and alkenylsuccinic anhydrides; half esters of unsaturated dibasic acids, such as methyl maleate half ester, ethyl maleate half ester, butyl maleate half ester, methyl citraconate half ester, ethyl citraconate half ester, butyl citraconate half ester, methyl itaconate half ester, methyl alkenylsuccinate half ester, methyl fumarate half ester, and methyl mesaconate half ester; unsaturated dibasic esters such as dimethyl maleate and dimethyl fumarate; α,β-unsaturated acids such as acrylic acid, methacrylic acid, crotonic acid and cinnamic acid; α,β-unsaturated acid anhydrides such as crotonic anhydride and cinnamic anhydride; anhydrides of the α,β-unsaturated acids with lower fatty acids; and alkenylmalonic acids, alkenylglutaric acids, alkenyladipic acids, acid anhydrides of these and monoesters of these.

It may still further include monomers having hydroxyl groups as exemplified by acrylates or methacrylates such as 2-hydroxyethyl acrylate, 2-hydroxyethyl methacrylate and 2-hydroxypropyl methacrylate; and 4-(1-hydroxy-1-methylbutyl)styrene and 4-(1-hydroxy-1-methylhexyl)styrene.

In the toner of the present invention, the vinyl copolymer unit of the binder resin may have a cross-linked structure, cross-linked with a cross-linking agent having at least two vinyl groups. The cross-linking agent used in such a case may include aromatic divinyl compounds as exemplified by divinylbenzene and divinylnaphthalene; diacrylate compounds linked with an alkyl chain, as exemplified by ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and the above compounds whose acrylate moiety has been replaced with methacrylate; diacrylate compounds linked with an alkyl chain containing an ether linkage, as exemplified by diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and the above compounds whose acrylate moiety has been replaced with methacrylate; diacrylate compounds linked with a chain containing an aromatic group and an ether linkage, as exemplified by polyoxythylene(2)-2,2-bis(4-hydroxyphenyl)propane diacrylate, polyoxythylene(4)-2,2-bis(4-hydroxyphenyl)propane diacrylate, and the above compounds whose acrylate moiety has been replaced with methacrylate.

As a polyfunctional cross-linking agent, it may include pentaerythritol triacrylate, trimethylolethane triacrylate, trimethylolpropane triacrylate, tetramethylolmethane tetraacrylate, oligoester acrylate, and the above compounds whose acrylate moiety has been replaced with methacrylate; triallylcyanurate, and triallyltrimellitate.

In the present invention, the vinyl copolymer (vinyl resin) component and/or the polyester resin component may preferably be incorporated with a monomer component capable of reacting with the both resin components. Among monomers included in the polyester resin component, a monomer component capable of reacting with the vinyl copolymer component may include, e.g., unsaturated dicarboxylic acids such as fumaric acid, maleic acid, citraconic acid and itaconic acid, or anhydrides thereof. Among monomers included in the vinyl copolymer component, a monomer component capable of reacting with the polyester resin component may include monomers having a carboxyl group or a hydroxyl group, and acrylates or methacrylates.

As a method for obtaining the reaction product of the vinyl copolymer component with the polyester resin component, preferred is a method in which, in the state the above monomer components capable of respectively reacting with the vinyl copolymer component and the polyester resin component are present, polymerization reaction for any one or both of the resins is carried out.

As a polymerization initiator used when the vinyl copolymer according to the present invention is used, it may include, e.g., azo compounds such as 2,2'-azobisisobutyronitrile, 2,2'-azobis-(4-methoxy-2,4-dimethylvaleronitrile), 2,2'-azobis-(2,4-dimethylvaleronitrile), 2,2'-azobis-(2-methylbutyronitrile), dimethyl-2,2'-azobisisobutyrate, 1,1'-azobis-(1-cyclohexane-1-carbonitrile), 2-(carbamoylazo)isobutyronitrile, 2,2'-azobis-(2,4,4-trimethylpentane), 2-phenylazo-2,4-dimethyl-4-methoxyvaleronitrile and 2,2'-azobis-(2-methyl-propane); ketone peroxides such as methyl ethyl ketone peroxide, acetylacetone peroxide and cylcohexanone peroxide; and other types such as 2,2-bis(t-butylperoxy)butane, t-butyl hydroperoxide, cumene hydroperoxide, 1,1,3,3-tetramethylbutyl hydroperoxide, di-t-butyl peroxide, t-butylcumyl peroxide, di-cumyl peroxide, α,α'-bis(t-butylperoxyisopropyl)benzene, isobutyl peroxide, octanoyl peroxide, decanoyl peroxide, lauroyl peroxide, 3,5,5-trimethylhexanoyl peroxide, benzoyl peroxide, m-trioyl peroxide, di-isopropyl-peroxydicarbonate, di-2-ethylhexyl peroxydicarbonate, di-n-propyl peroxydicarbonate, di-2-ethoxyethyl peroxydicarbonate, di-methoxyisopropyl peroxydicarbonate, di(3-methyl-3-methoxybutyl) peroxydicarbonate, acetylcylohexylsulfonyl peroxide, t-butyl peroxyacetate, t-butyl peroxyisobutyrate, t-butyl peroxyneodecanoate, t-butyl peroxy-2-ethylhexanoate, t-butyl peroxylaurate, t-butyl peroxylbenzoate, t-butyl peroxyisopropylcarbonate, di-t-butyl peroxyisophthalate, t-butyl peroxyallylcarbonate, t-amyl peroxy-2-ethylhexanoate, di-t-butyl peroxyhexahydrophthalate and di-t-butyl peroxyazelate.

Methods by which the hybrid resin used in the toner of the present invention can be produced, may include, e.g., the following production methods shown in (1) to (6).

(1) A method of blending a vinyl-type resin or polyester resin with a hybrid resin after they have independently be produced. These may be blended by dissolving and swelling them in an organic solvent (e.g., xylene), and the organic solvent is distilled away. As the hybrid resin, an ester compound may be used which is synthesized by separately producing a vinyl-type polymer unit and a polyester unit, and thereafter dissolving and swelling them in a small amount of organic solvent, followed by addition of an esterifying catalyst and an alcohol and then heating to effect ester exchange reaction.

(2) A method of producing a vinyl-type polymer unit and thereafter producing a polyester unit and a hybrid resin component in the presence of the vinyl-type polymer unit. The hybrid resin is produced by reacting the vinyl-type polymer unit (a vinyl-type monomer may optionally be added) with a polyester monomer (alcohol or carboxylic acid) and/or a polyester. In this case, too, any organic solvent may appropriately be used.

(3) A method of first producing a polyester unit and thereafter producing a vinyl-type copolymer unit and a hybrid resin component in the presence of the polyester unit. The hybrid resin is produced by reacting the polyester unit (a polyester monomer may optionally be added) with a vinyl monomer and/or the vinyl-type polymer unit.

(4) A vinyl-type polymer unit and a polyester unit are produced and thereafter a vinyl-type monomer and/or a polyester monomer (alcohol or carboxylic acid) is/are added to produce a hybrid resin. In this case, too, any organic solvent may appropriately be used.

(5) A hybrid resin is produced and thereafter a vinyl-type monomer and/or a polyester monomer (alcohol or carboxylic acid) is/are added to effect addition polymerization and/or polycondensation reaction to produce a vinyl-type polymer unit and polyester unit. In this case, as the hybrid resin, any of the hybrid resins produced by the above methods (2) to (4) may be used, or optionally a hybrid resin produced by any conventional method may also be used. Also, any organic solvent may appropriately be used.

(6) A vinyl-type monomer and a polyester monomer (alcohol or carboxylic acid) are mixed to effect addition polymerization and polycondensation reaction continuously and produce vinyl-type polymer units, polyester units and a hybrid resin component. Also, any organic solvent may appropriately be used.

In the above production processes (1) to (6), a plurality of polymer units having different molecular weights and different cross-linking degrees may be used as the vinyl-type polymer unit and/or the polyester unit.

As the binder resin contained in the toner of the present invention, a mixture of the polyester resin and the vinyl-type copolymer, a mixture of the hybrid resin and the vinyl-type copolymer and a mixture of the polyester resin and the hybrid resin and in addition thereto the vinyl-type copolymer may also be used.

The binder resin contained in the toner of the present invention may preferably have a glass transition temperature of from 40 to 90° C., and more preferably from 45 to 85° C. The binder resin may preferably have an acid value of from 1 to 40 mg·KOH/g.

A wax which may be used in the present invention is described below.

The toner of the present invention may preferably contain at least one type of wax.

From the viewpoint of achievement of both the low-temperature fixing performance and the anti-blocking properties, in virtue of the incorporation of a wax, the toner of the present invention may more preferably have, in the endothermic curve in the measurement by differential thermal analysis (or differential scanning calorimetry DSC), one or a plurality of endothermic peak(s) within the range of temperature of from 30 to 200° C., and a peak temperature of the maximum endothermic peak in the endothermic peaks, within the range of from 60 to 110° C. It may more preferably have the maximum peak of the endothermic curve within the range of temperature of from 65 to 100° C. If the peak temperature of the maximum endothermic peak is lower than 60° C., the toner may have poor anti-blocking properties. If on the other hand the peak temperature of the maximum endothermic peak is higher than 110° C., the toner may have a low fixing performance.

As examples of the wax used in the present invention, they may include the following: aliphatic hydrocarbon waxes such as low-molecular weight polyethylene, low-molecular weight polypropylene, microcrystalline wax and paraffin wax, oxides of aliphatic hydrocarbon waxes, such as polyethylene oxide wax, or block copolymers of these; waxes composed chiefly of a fatty ester, such as carnauba wax, sazol wax and montanate wax, or those obtained by subjecting part or the whole of fatty esters to deoxidizing treatment, such as dioxidized carnauba wax. It may further include saturated straight-chain fatty acids such as palmitic acid, stearic acid and montanic acid; unsaturated fatty acids such as brassidic acid, eleostearic acid and parinaric acid; saturated alcohols such as stearyl alcohol, aralkyl alcohol, behenyl alcohol, carnaubyl alcohol, ceryl alcohol and melissyl alcohol; polyhydric alcohols such as sorbitol; fatty acid amides such as linolic acid amide, oleic acid amide and lauric acid amide; saturated fatty acid bisamides such as methylenebis(stearic acid amide), ethylenebis(capric acid amide), ethylenebis(lauric acid amide) and hexamethylenebis(stearic acid amide); unsaturated fatty acid amides such as ethylenebis(oleic acid amide), hexamethylenebis (oleic acid amide), N,N'-dioleyladipic acid amide and N,N'-dioleylsebasic acid amide; aromatic bisamides such as m-xylenebisstearic acid amide, N,N'-distearylisophthalic acid amide; fatty acid metal salts (those commonly called metal soap) such as calcium stearate, calcium laurate, zinc stearate and magnesium stearate; grafted waxes obtained by grafting vinyl monomers such as styrene to fatty acid hydrocarbon waxes; partially esterified products of polyhydric alcohols with fatty acids, such as monoglyceride behenate; and methyl esterified product having a hydroxyl group, obtained by hydrogenation of vegetable fats and oils.

Waxes particularly preferably usable in the present invention may include aliphatic hydrocarbon waxes. For example, they may be low-molecular weight alkylene polymers obtained by polymerizing alkylenes by radical polymerization under high pressure, or by polymerization under low pressure in the presence of a Ziegler catalyst; alkylene polymers obtained by thermal decomposition of high-molecular weight alkylene polymers; and synthetic hydrocarbon waxes obtained from, or by hydrogenation of, distillation residues of hydrocarbons obtained by the Arge process from synthetic gases comprised of carbon monoxide and hydrogen. Hydrocarbon waxes fractionated by using press sweating, solvent fractionation or vacuum distillation, or by a fractionation recrystallization system may more preferably be used.

The hydrocarbons, serving as a matrix, may include those synthesized by reacting carbon monoxide with hydrogen in the presence of a metal oxide type catalyst (usually catalysts of a two or more multiple system), as exemplified by hydrocarbons obtained by the Synthol method or the Hydrocol process (making use of a fluidized catalyst bed); hydrocarbons having about several hundred carbon atoms, obtained by the Arge process (making use of a fixed catalyst bed) which can obtain waxy hydrocarbons in a large quantity; and hydrocarbons obtained by polymerization of alkylenes such as ethylene in the presence of a Ziegler catalyst; all of which are preferable as having less and small branches and being saturated long straight chain hydrocarbons. In particular, waxes synthesized by the method not relying on the polymerization of alkylenes are preferred in view of their molecular weight distribution.

The wax may preferably have, in its molecular weight distribution, a main peak in the region of molecular weight of from 400 to 2,400, and more preferably in the region of molecular weight of from 430 to 2,000. Waxes made to have such a molecular weight distribution can endow the toner with preferable thermal properties.

In order to make the toner function more effectively at the time of fixing, the wax may preferably have a melting point of from 60 to 110° C., and more preferably from 65 to 100° C.

The wax may be used in an amount of from 0.5 to 10 parts by weight, and preferably from 2 to 8 parts by weight, based on 100 parts by weight of the binder resin.

The wax may usually be incorporated into the binder resin by a method in which the resin is dissolved in a solvent and the resin solution formed is heated, where the wax is added and mixed with stirring, or a method in which it is mixed at the time of kneading.

The toner used in the present invention may be incorporated with an organometallic compound. The organometallic compound used in the present invention may preferably be a metallic compound of an aromatic carboxylic acid derivative selected from an aromatic oxycarboxylic acid and an aromatic alkoxycarboxylic acid. As metals that form such organometallic compounds, divalent or higher metallic atoms are preferred. Divalent metals may include $Mg^{2+}$, $Ca^{2+}$, $Sr^{2+}$, $Pb^{2+}$, $Fe^{2+}$, $Co^{2+}$, $Ni^{2+}$, $Zn^{2+}$ and $Cu^{2+}$. As the divalent metals, $Zn^{2+}$, $Ca^{2+}$, $Mg^{2+}$ and $Sr^{2+}$ are preferred. Trivalent or higher metals may include $Al^{3+}$, $Cr^{3+}$, $Fe^{3+}$ and $Ni^{3+}$. Of these metals, preferred are $Al^{3+}$ and $Cr^{3+}$, and particularly preferred is $Al^{3+}$.

In the present invention, an aluminum compound of di-tert-butylsalicylic acid is particularly preferred as the organometallic compound.

The metal compound of an aromatic carboxylic acid derivative selected from an aromatic oxycarboxylic acid and an aromatic alkoxycarboxylic acid may be synthesized by, e.g., dissolving an oxycarboxylic acid or an alkoxycarboxylic acid in an aqueous sodium hydroxide solution, adding dropwise to the aqueous sodium hydroxide solution an aqueous solution in which a divalent or higher metal atom has been melted, heating and stirring the solution, then adjusting its pH, and cooling the solution to room temperature, followed by filtration and water washing to obtain a metal compound of the aromatic oxycarboxylic acid or aromatic alkoxycarboxylic acid. It should be noted that the method is by no means limited only to such a synthesis method.

The organometallic compound may preferably be used in an amount of from 0.1 to 10 parts by weight based on the weight of the toner. This is preferable because the charge quantity of the toner may less vary at the initial stage, the absolute charge quantity necessary at the time of development can be easily obtained, and consequently any lowering of image quality such as "fog" and image density decrease does not occur.

If the organometallic compound is in a content of less than 0.1% by weight on the bases of the weight of the toner (or not added at all), the toner may have unstable charge quantity at the time of extensive operation (running), resulting in a poor image density maintenance performance. If on the other hand the organometallic compound is in a content of more than 10% by weight based on the weight of the toner, the toner may conversely undergo charge-up to come to cause a decrease in image density.

To produce color toner particles used in the present invention, the binder resin, the pigment as a colorant, the wax, and optionally a charge control agent and other additives are thoroughly mixed by means of a mixing machine such as a ball mill, and then the mixture is melt-kneaded by means of a heat kneading machine such as a heat roll, a kneader or an extruder to make the resin and so forth melt one another, in which the pigment is dispersed, followed by cooling for solidification and thereafter pulverization and strict classification. Thus, the color toner particles can be obtained.

In order to improve the state of dispersion of pigment particles in the color toner particles, it is preferable to put into a kneader or a mixer a first binder resin and a pasty pigment containing 5 to 50% by weight of pigment particles insoluble in the dispersion medium, introduce them into a kneader or a mixer, heat them while mixing them under no application of pressure to cause the first binder resin to melt to move the pasty resin (i.e., pigment in liquid phase) to the molten-resin phase of the first binder resin kept heated, thereafter melt-knead the first binder resin and the pigment particles, followed by removal of the liquid component by evaporation and then drying to obtain a first kneaded product containing the first binder resin and the pigment particles, and then add to the first kneaded product a second binder resin and also optionally additives such as a charge control agent to prepare a mixture, melt-knead the mixture with heating to obtain a second kneaded product, and cool the second kneaded product, followed by pulverization and classification to produce a toner. Here, the first binder resin and the second binder resin may be resins of the same type or may be different resins.

The above pasty pigment may preferably be in a state that in the step of producing pigment particles the pigment particles are present without having passed through any drying step. In other words, it is a condition in which the pigment particles are present substantially in the state of primary particles in an amount of from 5 to 50% by weight based on the total weight of the pasty pigment. The remaining 50 to 95% by weight in the pasty pigment is held by the greater part of a volatile liquid together with some quantities of a dispersant and an auxiliary agent. There are no particular limitations on the volatile liquid as long as it is a liquid which evaporates upon usual heating. A liquid that may preferably be used also in view of ecology is water.

The kneading machine may include heat kneaders, single-screw extruders, twin-screw extruders, and kneaders, and may particularly preferably include heat kneaders.

In view of an improvement in image quality and in view of storage stability in a high-temperature environment, the toner of the present invention may still more preferably have a fluidity improver added externally. The fluidity improver may preferably be an inorganic fine power such as fine silica powder, fine titanium oxide powder or fine aluminum oxide powder. Such an inorganic fine power may preferably be one having been made hydrophobic with a hydrophobic-treating agent such as a silane coupling agent, a silicone oil or a mixture of these.

The hydrophobic-treating agent may include coupling agents such as a silane coupling agent, a titanate coupling agent, an aluminum coupling agent and a zircoaluminate coupling agent.

Stated specifically, the silane coupling agent may preferably be a compound represented by the following general formula:

$$R_mSiY_n$$

wherein R represents an alkoxyl group; m represents an integer of 1 to 3; Y represents an alkyl group, a vinyl group, a phenyl group, a methacrylic group, an amino group, an epoxy group, a mercapto group or a derivative of any of these; and n represents an integer of 1 to 3.

Such a compound may include, e.g., vinyltrimethoxysilane, vinyltriethoxysilane, γ-methacryloxypropyltrimethoxysilane, methyltrimethoxysilane, methyltriethoxysilane, isobutyltrimethoxysilane, dimethyldimethoxysilane, dimethyldiethoxysilane, trimethylmethoxysilane, hyroxypropyltrimethoxysilane, phenyltrimethoxysilane, n-hexadecyltrimethoxysilane and n-octadecyltrimethoxysilane.

In the treatment, the silane coupling agent may be used in an amount of from 1 to 60 parts by weight, and preferably from 3 to 50 parts by weight, based on 100 parts by weight of the inorganic fine power.

What is particularly preferred in the present invention is an alkylalkoxysilane coupling agent represented by the general formula:

$$C_nH_{2n+1}—Si—(OC_mH_{2m+1})_3$$

wherein n represents an integer of 4 to 12, and m represents an integer of 1 to 3.

In the alkylalkoxysilane coupling agent, if n is smaller than 4, though hydrophobic treatment may be made with ease, a low hydrophobicity may result undesirably. If on the other hand n is larger than 12, though hydrophobicity can be sufficient, fine powder particles may greatly coalesce one another to tend to have a low fluidity-providing ability. If m is larger than 3, the alkylalkoxysilane coupling agent may have a low reactivity to make it hard for the inorganic fine powder to be made well hydrophobic. Accordingly, in the alkylalkoxysilane coupling agent, n may preferably be from 4 to 8, and m may preferably be 1 or 2.

In the treatment with the alkylalkoxysilane coupling agent, the agent may be used in an amount of from 1 to 60 parts by weight, and preferably from 3 to 50 parts by weight, based on 100 parts by weight of the inorganic fine power.

The hydrophobic treatment may be made using one kind of hydrophobic-treating agent alone, or using two or more kinds of hydrophobic-treating agents. For example, the hydrophobic treatment may be made using one kind of coupling agent alone or using two kinds of coupling agents simultaneously, or the hydrophobic treatment may be made first using one coupling agent and thereafter further using another coupling agent.

The fluidity improver may preferably be added in an amount of from 0.01 to 5 parts by weight, and preferably from 0.05 to 3 parts by weight, based on 100 parts by weight of the toner particles.

The color toner of the present invention is applicable to both one-component developers and two-component developers without any particular limitations thereon. As a carrier used in combination in the case when the toner of the present invention is used in two-component developers, usable are particles of, e.g., metals such as iron, nickel, copper, zinc, cobalt, manganese, chromium and rare earth elements, which may be surface-oxidized or unoxidized, alloys or oxides of any of these, and ferrite.

In particular, an Mn—Mg—Fe three-element magnetic ferrite particles formed of manganese, magnesium and iron components as chief components are preferred as carrier particles. Such magnetic carrier particles may preferably be those having been coated with a resin. As the resin, silicone resins are preferred. In particular, a nitrogen-containing silicone resin or a modified silicone resin formed by the reaction of a nitrogen-containing silane coupling agent with a silicone resin is preferred in view of the providing of negative triboelectric charges to the color toner of the present invention, the environmental stability of the toner and the prevention of carrier particle surfaces from contamination.

Such a magnetic carrier may preferably have an average particle diameter of from 15 to 60 μm, and more preferably form 25 to 50 μm, in relation to the weight-average particle diameter of the color toner.

As a method for preparing the magnetic carrier so as to have the above average particle diameter and specific particle size distribution, for example, sieves may be used to make classification. In order to make the classification especially in a good precision, carrier particles may preferably be sieved several times repeatedly, using sieves having suitable mesh sizes. It is also an effective means to use a sieve whose mesh opening shapes have been controlled by plating or the like.

When the two-component developer is prepared, good results are obtainable where the toner and the carrier are blended in such a proportion that the toner in the developer is in a concentration of from 2 to 15% by weight, and preferably from 4 to 13% by weight. If the toner is in a concentration lower than 2% by weight, a low image density tends to result. If it is in a concentration higher than 15% by weight, fog and in-machine toner scatter tend to occur.

An example of the image forming method of the present invention is described in detail below with reference to FIG. 1.

FIG. 1 is a schematic drawing illustrating the construction of an image forming apparatus to which the image forming method of the present invention can be applied.

This image forming apparatus is used as a full color copying machine. The full color copying machine comprises an upper digital color image reader unit 35, and a lower digital color image printer unit 36, as shown in FIG. 1.

In the image reader unit, an original 30 is placed on an original glass base 31, and is exposed and scanned by an exposure lamp 32, and the light reflected from the original 30 is converged to a full color sensor 34 by a lens 33 to obtain a color separation image signal. The color separation image signal is passed through an amplifying circuit (not shown) and then processed by a video processing unit (not shown) to be sent to the digital image printer unit.

In the image printer unit, a photosensitive drum 1 as a latent image holding member comprises a photosensitive member such as an organic photoconductive member and is provided so as to be rotatable in the direction shown by an arrow. A pre-exposure lamp 11, a corona charger 2 as a primary charging member, a laser exposure optical system 3 as latent image forming means, a potential sensor 12, four developing devices 4Y, 4C, 4M and 4K having different colors, drum light detecting means 13, a transfer device 5A and a cleaning device 6 are disposed around the photosensitive drum 1.

In the laser exposure optical system 3, the image signal output from the reader unit is converted into an optical signal derived from scanning exposure of the image by a laser output unit (not shown) to generate a laser beam which is reflected by a polygon mirror 3*a* and projected to the surface of the photosensitive drum 1 through a lens 3*b* and a mirror 3*c*.

In the printer unit, in image formation, the photosensitive drum 1 is rotated in the direction shown by an arrow so as to be de-charged by the pre-exposure lamp 11 and then uniformly negatively charged by the charger 2, and light E is applied for each of the separated colors to form a latent image on the photosensitive drum 1.

The latent image is developed by operating a predetermined developing device to form a visible image, i.e., a toner image, on the photosensitive drum 1 by using a resin-based negative toner. In development, the developing devices 4Y, 4C, 4M and 4K are selectively brought near to the photosensitive drum 1 by operating eccentric cams 24Y, 24C, 24M and 24K according to the separated colors.

The transfer device 5A comprises a transfer drum 5, a transfer charger 5*b*, an attraction charger 5*c* for electrostatically attracting the recording material and an attraction roller 5*g* opposite thereto, an internal charger 5*d*, an external charger 5*e* and a separation charger 5*h*. The transfer drum 5 is axially rotatably supported, and a transfer sheet 5*f* as a recording material bearing member for bearing the recording material is integrally provided in an open area of the peripheral surface thereof. The transfer sheet 5*f* comprises a polycarbonate film.

The recording material is conveyed to the transfer drum 5 from a recording cassette 7*a*, 7*b* or 7*c* through a recording material conveyance system, and is borne on the transfer sheet 5*f*. The recording material borne on the transfer drum 5 is repeatedly conveyed to a transfer position opposite to the photosensitive drum 1 with rotation of the transfer drum 5 to transfer the toner image formed on the photosensitive drum 1 onto the recording material by the action of the transfer charger 5*b* during passage through the transfer position.

The aforementioned image forming steps are repeated for yellow (Y), magenta (M), cyan (C) and black (K) to obtain a transferred color image by superposing toner images having the four colors on the recording material on the transfer drum 5.

In the image formation on one side of the recording material, as described above, the recording material onto which the toner images having four colors are transferred is separated from the transfer drum 5 by the action of a separation claw 8*a*, a separation pushing-up roller 8*b* and the separation charger 5*h*, and then sent to a heat fixing device 9. The heat fixing device 9 comprises a heat fixing roller 9*a* containing heating means, and a pressure roller 9*b*. The recording material is passed through the pressure contact portion between the heat fixing roller 9*a* as a heating member and the pressure roller 9*b* to fix the full color image borne on the recording material to the recording material. Namely, a full color permanent image is formed by color mixing and color development of the toners, and fixing to the recording material in the fixing step, and is then delivered to a tray 10 to complete copying of a full color image. On the other hand, residual toner on the surface of the photosensitive drum 1 is cleaned off by the cleaning device 6, the photosensitive drum 1 is then subjected to the image forming process again.

In the image forming method of the present invention, the toner image obtained by developing the electrostatic latent image formed on the latent image bearing member may be transferred onto the recording material through an intermediate transfer member. Namely, this image forming method comprises the steps of transferring the toner image formed by developing the electrostatic latent image formed on the latent image bearing member onto the intermediate transfer member, and transferring the toner image transferred onto the intermediate transfer member onto the recording material.

Methods of measuring various physical properties of the toner are described below.

Measurement of spectral sensitivity of toner:

Value L* and spectral sensitivity of color toner in the state of powder is measured with a spectroscopic color difference meter SE-2000 (manufactured by Nippon Denshoku Kogyo K. K.) according to JIS Z-8722, using C-light source as a light source and setting the visual angle at 2°. These are measured along attached instructions. To fit a standard plate to the standard, it is better to do so in a state that a sheet of glass of 2 mm thick and 30 mm diameter is interposed in a powder measuring cell set as an option. Stated in greater detail, the measurement is made in a state that a cell filled with a sample powder is placed on a sample stand (attachment) for powder sample, of the above spectroscopic color difference meter. Here, before the cell is placed on the sample stand for powder sample, the measurement is made after vibration of once/second is applied for 30 seconds on a vibration stand.

Measurement of storage elastic modulus of toner:

Toner is pressure-molded into a disk-like sample having a diameter of 25 mm and a thickness of from about 2 to 3 mm. Next, the sample is set between parallel plates, and then heated gradually within the temperature region of from 50 to 200° C. to make measurement of temperature dispersion. Heating rate is set at 2° C./min, angular frequency (ω) is fixed at 6.28 rad/sec., and measurement of distortion rate is set automatic. The temperature is plotted as abscissa and the storage elastic modulus (G') as ordinate, and values at every temperature are read. In the measurement, RDA-II (trade name; manufactured by Rheometrics Co.) is used.

Measurement of endothermic peak of toner:

Measured according to ASTM D3418-82, using a differential thermal analyzer (DSC measuring device) DSC-7 (manufactured by Perkin-Elmer Corporation).

A sample for measurement is precisely weighed in an amount of from 2 to 10 mg, preferably 5 mg. This sample is put in a pan made of aluminum and an empty aluminum pan is set as reference. Measurement is made in a normal-temperature normal-humidity environment at a heating rate of 10° C./min within the measuring temperature range of from 30 to 200° C. In the course of this heating, main peak endothermic peaks of the DSC curve in the temperature range of from 30 to 200° C. are obtained.

EXAMPLES

The present invention is described below by giving specific working examples. The present invention is by no means limited to these examples.

Hybrid Resin Production Example 1

As materials (monomers, cross-linking agent and polymerization initiator) for the vinyl copolymer unit, 1.9 mols of styrene, 0.21 mol of 1,2-ethylhexyl acrylate, 0.15 mol of fumaric acid, 0.03 mol of a dimer of α-methylstyrene and 0.05 mol of dicumyl peroxide were put into a dropping funnel. Also, as materials for the polyester unit, 7.0 mols of polyoxypropylene(2.2)-2,2-bis(4-hydroxyphenyl)propane, 3.0 mols of polyoxyethylene(2.2)-2,2-bis(4-hydroxyphenyl) propane, 3.0 mols of terephthalic acid, 2.0 mols of trimellitic anhydride, 5.0 mols of fumaric acid and 0.2 g of dibutyltin oxide were put into a 4-liter four-necked flask made of glass, and a thermometer, a stirring rod, a condenser and a nitrogen feed tube were attached thereto. This was placed in a mantle heater.

Next, the inside of the flask was displaced with nitrogen gas, followed by gradual heating with stirring. With stirring at a temperature of 145° C., the monomers, cross-linking agent and polymerization initiator for the vinyl copolymer were dropwise added thereto over a period of 4 hours. Subsequently, the mixture was heated to 200° C. to carry out reaction for 4 hours to obtain a hybrid resin, Resin (1). Its molecular weight was measured by GPC to obtain the results shown in Table 1.

Hybrid Resin Production Example 2

The reaction was carried out in the same manner as in Hybrid Resin Production Example 1 except that 3.8 mols of styrene, 0.07 mol of a dimer of α-methylstyrene and 0.1 mol of dicumyl peroxide were used as the materials for vinyl copolymer, to obtain a hybrid resin, Resin (2). Its molecular weight was measured by GPC to obtain the results shown in Table 1.

Hybrid Resin Production Example 3

The reaction was carried out in the same manner as in Hybrid Resin Production Example 1 except that in place of 5.0 mols of the fumaric acid 4.0 mols of maleic acid and 3.5 mols of itaconic acid were used and in place of 0.05 mol of the dicumyl peroxide 0.1 mol of isobutyl peroxide was used, to obtain a hybrid resin, Resin (3). Its molecular weight was measured by GPC to obtain the results shown in Table 1.

Hybrid Resin Production Example 4

The reaction was carried out in the same manner as in Hybrid Resin Production Example 1 except that in place of 3.0 mols of the terephthalic acid and 2.0 mols of the trimellitic anhydride 5.2 mols of trimellitic anhydride was used, to obtain a hybrid resin, Resin (4). Its molecular weight was measured by GPC to obtain the results shown in Table 1.

Polyester Resin Production Example 1

3.6 mols of polyoxypropylene(2.2)-2,2-bis(4-hydroxyphenyl)propane, 1.6 mols of polyoxyethylene(2.2)-2,2-bis (4-hydroxyphenyl)propane, 1.7 mols of terephthalic acid, 1.1 mols of trimellitic anhydride, 2.4 mols of fumaric acid and 0.1 g of dibutyltin oxide were put into a 4-liter four-necked flask made of glass, and a thermometer, a stirring rod, a condenser and a nitrogen feed tube were attached thereto. This was placed in a mantle heater. In an atmosphere of nitrogen, reaction was carried out at 215° C. for 5 hours to obtain a polyester resin, Resin (5). Its molecular weight was measured by GPC to obtain the results shown in Table 1.

Polyester Resin Production Example 2

With monomer constitution of 1.6 mols of polyoxypropylene(2.2)-2,2-bis(4-hydroxyphenyl)propane, 3.3 mols of polyoxyethylene(2.2)-2,2-bis(4-hydroxyphenyl)propane, 1.6 mols of terephthalic acid, 0.3 mol of trimellitic anhydride and 3.2 mols of fumaric acid, reaction was carried out like that in the above, to obtain a polyester resin, Resin (6). Its molecular weight was measured by GPC to obtain the results shown in Table 1.

Vinyl Resin Production Example 1

2.2 mols of styrene, 0.23 mol of 1,2-ethylhexyl acrylate, 0.08 mol of dicumyl peroxide and 3.2 g of dibutyltin oxide were put into a 3-liter four-necked flask having a thermometer, a stirring rod made of stainless steel, a falling-film condenser and a nitrogen feed tube. In a mantle heater, in an atmosphere of nitrogen, reaction was carried out at a temperature of 225° C. with stirring to obtain a vinyl resin, Resin (7) (vinyl copolymer). Its molecular weight was measured by GPC to obtain the results shown in Table 1.

TABLE 1

Molecular Weight Measurement Results (GPC)

| | Mw ($\times 10^3$) | Mn ($\times 10^3$) | Mp ($\times 10^3$) | Mw/Mn |
|---|---|---|---|---|
| Hybrid resin: | | | | |
| Resin (1) | 83.0 | 3.1 | 15.4 | 26.77 |
| Resin (2) | 72.1 | 3.2 | 15.1 | 22.53 |
| Resin (3) | 108.1 | 4.2 | 30.3 | 25.74 |
| Resin (4) | 294.9 | 4.5 | 89.4 | 65.53 |
| Polyester resin: | | | | |
| Resin (5) | 25.7 | 3.2 | 6.4 | 8.03 |
| Resin (6) | 4.3 | 2.2 | 3.1 | 1.95 |
| Vinyl resin: | | | | |
| Resin (7) | 19.0 | 2.7 | 9.1 | 7.04 |

Waxes used in the following Examples and Comparative Examples are shown in Table 2 below.

TABLE 2

| | Melting point | Type of wax |
|---|---|---|
| Wax (A) | 74.3° C. | Purified normal paraffin |
| Wax (B) | 72.8° C. | Ester wax |
| Wax (C) | 58.9° C. | Paraffin |
| Wax (D) | 95.2° C. | Polyethylene |
| Wax (E) | 111.4° C. | Alcohol-modified PE |

Example 1

Yellow toner 1 was prepared in the following way.

First Kneading Step:

| | (by weight) |
|---|---|
| Hybrid resin, Resin (1) | 70 parts |
| Pasty pigment with 30% by weight of solid content, obtained by removing water to a certain extent from a pigment slurry containing in a weight ratio of 84:16 C.I. Pigment Yellow 155 selected from the compound (1) group and C.I. Pigment Yellow 147 selected from the compound (2) group, without having passed through any drying step at all (remaining 70% by weight: water) | 30 parts |

The above materials were introduced into a kneader type mixer under the above formulation, and were heated with stirring under application of no pressure. At the time the resultant mixture reached a maximum temperature (which depends necessarily on the boiling point of a solvent in the paste; in this case, about 90 to 100° C.), the pigment in aqueous phase became distributed or moved to the molten resin phase. Having made sure of this, the mixture was further melt-kneaded for 30 minutes with heating to cause the pigments in the paste to move sufficiently to the resin phase. Thereafter, the mixer was first stopped, and the hot water was discharged. Then the mixture was further heated to 130° C. and melt-kneaded for about 30 minutes with heating to disperse the pigment, and at the same time the water was evaporated off to stop the kneading step, followed by cooling to take out the kneaded product to obtain a first kneaded product. This first kneaded product had a water content of about 0.5% by weight.

Second Kneading Step:

| | (by weight) |
|---|---|
| The above first kneaded product | 100 parts |
| Content of pigment particles in the whole resin | 9.5 parts |
| Wax (A) | 5.0 parts |
| Aluminum compound of di-tert-butylsalicylic acid (charge control agent) | 5.0 parts |

The above materials were premixed by means of a Henschel mixer, and the mixture obtained was melt-kneaded using a twin-screw kneader, setting its temperature at 100° C. This kneaded product was cooled and thereafter crushed by means of a hammer mill into about 1 to 2 mm in diameter. The crushed product was then finely pulverized by means of a fine grinding mill of an air jet system into particles of about 20 μm or less in diameter. The finely pulverized product thus obtained was further classified, and the classified product was so selected as to have a weight-average particle diameter of 7.2 μm in its particle size distribution, to obtain yellow toner particles (classified product).

In order to improve fluidity and provide chargeability, 1.0 part by weight of hydrophobic fine aluminum oxide powder (BET specific surface area: 170 $m^2/g$) having been treated with 25 parts by weight of $i\text{-}C_4H_9Si(OCH_3)_3$ was added to 100 parts by weight of the above yellow toner particles (resin particles) to obtain yellow toner 1.

The yellow toner 1 was further blended with magnetic ferrite carrier particles (average particle diameter: 45μm) surface-coated with silicone resin, which were so blended as to be in a toner concentration of 7% by weight. Thus, a two-component yellow developer 1 was obtained. A list of the formulation of the yellow toner 1 is shown as Table 3.

Using this yellow developer 1 and using a remodeled machine of a color copying machine CLC-800 (trade name, manufactured by CANON INC.), from a fixing unit of which an oil application mechanism had been detached, a 10,000-sheet running test was conducted in a monochromatic mode in a normal-temperature and low-humidity environment (23° C./5% RH) and a high-temperature and high-humidity environment (30° C./80% RH), and also a fixing test was made in a normal-temperature and normal-humidity environment (23° C./60% RH), both using an original having an image area percentage of 20%. Further, in respect of the evaluation of the fixable temperature range, the fixing unit was so remodeled as to be able to set the fixing temperature manually.

Even after the 10,000-sheet running test, yellow images free of fog and having reproduced the original image faithfully were obtained, showing a superior color reproducibility. Paper transport through the interior of the copying machine and detection of developer concentration were also good, and stable image density was obtained. In repeated copying on 10,000 sheets setting the fixing temperature to 170° C., too, any offset to the fixing roller did not occur at all. Here, the occurrence of offset to the fixing roller was checked by visual observation of the surface of the fixing roller after the repeated copying.

As to the charging stability in this Example, images after 10,000-sheet running in the normal-temperature and low-humidity environment (23° C./5% RH) were evaluated on the basis of evaluation criteria shown below. The results are shown in Table 4.

Using the spectroscopic color difference meter SE-2000 (manufactured by Nippon Denshoku Kogyo K.K), the reflectance of the yellow toner 1 was also determined as the toner was kept in the state of powder, to find that it was 17.2% at the wavelength of 500 nm and 77.4% at the wavelength of 600 nm. The results are shown in Table 4.

The yellow developer 1 prepared using the yellow toner 1 was also used in the remodeled machine of a color copying machine CLC-800 (trade name, manufactured by CANON INC.), from a fixing unit of which an oil application mechanism had been detached, and images were reproduced in a monochromatic mode in the normal-temperature and low-humidity environment (23° C./5% RH). The color tone of this yellow toner 1 was quantitatively measured in accordance with the definition of the calorimetric system as standardized in 1976 by The Commission Internationale de l'Eclairage, Paris (CIE). Here, the image density was fixed at 1.70, and a*, b* (a* and b* represent chromaticity which indicates hue and saturation, respectively) and L* (lightness) were measured. A spectral colorimeter Type-938, manufactured by X-Rite Co., was used as a measuring instrument, and a C-light source as a light source for observation. The visual angle was set at 2°.

As the result, the yellow monochromatic images obtained were found to be L*=85.7, a*=−6.5 and b*=90.1, which were substantially in agreement with the average color (commonly called Japan color) of process inks (Δ=1.3). Thus, what was targeted was obtained. The difference AE of the resultant chromaticity from a Japan color standard chart was calculated to make evaluation according to the following criteria. The results are shown in Table 4.

(Evaluation Criteria)
A: ΔE is less than 3 (good).
B: ΔE is 3 to 6 (within a tolerable range).
C: ΔE is 6 or more (failure).

Color images formed on transparency films (OHT) were also projected by means of an overhead projector (OHP). OHT images thus projected showed a good. transparency.

With regard to the transparency of the OHT images in this Example, color images formed on the transparency film were projected using a commercially available overhead projector, and their transparency was evaluated according to the following evaluation criteria. The results are shown in Table 4.

(Evaluation Criteria)
A: Having a superior transparency, free of uneven brightness, and also having a superior color reproducibility (good).
B: Having an uneven brightness slightly, but no problem in practical use (passable).
C: Having an uneven brightness and having a poor color reproducibility (failure).

Light-fastness of the yellow solid images obtained (image density: 1.70) was examined substantially according to JIS K7102. As a result, images after 400 hour exposure to light showed substantially the same image density (1.66) as those at the initial stage, and also almost no changes in hue were seen (ΔE=2.8). Here, a carbon arc lamp was used as a light source. As criteria for the evaluation of light-fastness, ΔE values were determined from images after the exposure to make evaluation quantitatively. The results are shown in Table 4.

(Light-Fastness Ranks)
A: Change is little seen in 400-hour testing.
B: Change is little seen in 200-hour testing.
C: Fading occurs in 100-hour testing.

As a result of examination of the storage stability of the yellow toner 1, good data were shown. More specifically, with regard to anti-blocking properties of sample toners, it was evaluated after the samples were left for 2 weeks in a 50° C. oven. To make evaluation, the level of agglomeration was visually judged. The results are shown in Table 4.

(Anti-Blocking Properties Evaluation Criteria)
A: No agglomerate is seen at all, showing very good fluidity.
B: Some agglomerates are seen, but become loose easily.
C: Agglomerates do not become loose well by means of a developer agitator.

Example 2

A yellow toner 2 was prepared in substantially the same manner as in Example 1 except that in place of the hybrid resin Resin (1) the hybrid resin Resin (2) was used and the pigment of the compound (2) group was changed for C.I. Pigment Yellow 110 (0.5 part: by weight; the same applies hereinafter). A yellow developer 2 was obtained in the same way. The formulation of the toner is shown in Table 3. A list of the results of measurement of physical properties and results of evaluation is shown as Table 4.

Example 3

A yellow toner 3 was prepared in substantially the same manner as in Example 1 except that in place of the hybrid resin Resin (1) the hybrid resin Resin (3) was used and the pigment of the compound (2) group was changed for C.I. Pigment Yellow 139 (1.0 part). A yellow developer 3 was obtained in the same way. The formulation of the toner is shown in Table 3. A list of the results of measurement of physical properties and results of evaluation is shown as Table 4.

Example 4

A yellow toner 4 was prepared in substantially the same manner as in Example 1 except that in place of the hybrid resin Resin (1) the polyester resin Resin (5) was used, the pigment of the compound (1) group was used in an amount changed to 1.0.0 parts and the pigment of the compound (2) group was changed for C.I. Pigment Yellow 110 (0.2 part). A yellow developer 4 was obtained in the same way. The formulation of the toner is shown in Table 3. A list of the results of measurement of physical properties and results of evaluation is shown as Table 4.

Example 5

A yellow toner 5 was prepared in substantially the same manner as in Example 1 except that in place of the hybrid resin Resin (1) the vinyl resin Resin (7) was used and the pigment of the compound (2) group was used in an amount changed to 3.0 parts. A yellow developer 5 was obtained in the same way. The formulation of the toner is shown in Table 3. A list of the results of measurement of physical properties and results of evaluation is shown as Table 4.

Example 6

A yellow toner 6 was prepared in substantially the same manner as in Example 1 except that the pigment of the compound (1) group was changed for C.I. Pigment Yellow 17 (7.0 parts), the pigment of the compound (2) group was used in an amount changed to 1.3 parts and the wax (A) used was changed for the wax (B). A yellow developer 6 was obtained in the same way. The formulation of the toner is shown in Table 3. A list of the results of measurement of physical properties and results of evaluation is shown as Table 4.

Example 7

A yellow toner 7 was prepared in substantially the same manner as in Example 1 except that the pigment of the compound (1) group was changed for C.I.

Pigment Yellow 62 (12.0 parts), the pigment of the compound (2) group was used in an amount changed to 1.0 part and the wax (A) used was changed for the wax (D). A yellow developer 7 was obtained in the same way. The formulation of the toner is shown in Table 3. A list of the results of measurement of physical properties and results of evaluation is shown as Table 4.

Example 8

A yellow toner 8 was prepared in substantially the same manner as in Example 1 except that the pigment of the compound (1) group was changed for C.I. Pigment Yellow 74 (7.0 parts), the pigment of the compound (2) group was used in an amount changed to 0.7 part and the wax (A) used was changed for the wax (C). A yellow developer 8 was obtained in the same way. The formulation of the toner is shown in Table 3. A list of the results of measurement of physical properties and results of evaluation is shown as Table 4.

Example 9

A yellow toner 9 was prepared in substantially the same manner as in Example 1 except that the pigment of the compound (1) group was changed for C.I. Pigment Yellow 93 and the pigment of the compound (2) group was used in an amount changed to 0.8 part. A yellow developer 9 was obtained in the same way. The formulation of the toner is shown in Table 3. A list of the results of measurement of physical properties and results of evaluation is shown as Table 4.

Example 10

A yellow toner 10 was prepared in substantially the same manner as in Example 1 except that the pigment of the compound (1) group was changed for C.I. Pigment Yellow 97 and the pigment of the compound (2) group was used in an amount changed to 0.7 part. A yellow developer 10 was obtained in the same way. The formulation of the toner is shown in Table 3. A list of the results of measurement of physical properties and results of evaluation is shown as Table 4.

Example 11

A yellow toner 11 was prepared in substantially the same manner as in Example 1 except that the pigment of the compound (1) group was changed for C.I. Pigment Yellow 168 (11.0 parts) and the pigment of the compound (2) group was used in an amount changed to 1.2 parts. A yellow developer 11 was obtained in the same way. The formulation of the toner is shown in Table 3. A list of the results of measurement of physical properties and results of evaluation is shown as Table 4.

Comparative Example 1

A yellow toner 12 was prepared in substantially the same manner as in Example 1 except that a single-pigment system was employed in which in place of the hybrid resin Resin (1) the hybrid resin Resin (4) was used and the pigment of the compound (2) group was not used at all. A yellow developer 12 was obtained in the same way. The formulation of the toner is shown in Table 3. A list of the results of measurement of physical properties and results of evaluation is shown as Table 4.

The yellow toner 12 was composed of a resin having a large value of Mw/Mn, so that the G' at 80° C. also showed so large value that the toner came very hard. Also, since the pigment of the compound (2) group was not used in combination, the chromaticity of the toner in the state of powder also shifted to a green tint, and consequently the reproduced images also had a color tone greatly deviating from that of process inks. This toner also had a poor OHP transparency, and also showed a very poor low-temperature fixing performance.

Comparative Example 2

A yellow toner 13 was prepared in substantially the same manner as in Example 1 except that in place of the hybrid resin Resin (1) the polyester resin Resin (6) was used, C.I. Pigment Yellow 147 in the pigment of the compound (2) group was used alone in an amount of 6.0 parts without using the compound (1) group. A yellow developer 13 was obtained in the same way. The formulation of the toner is shown in Table 3. A list of the results of measurement of physical properties and results of evaluation is shown as Table 4.

The yellow toner 13 was composed of a resin having a small value of Mw/Mn, so that the G' at 80° C. also showed a small value and, in the fixing test, the transfer paper wound around the upper roller at low-temperature (140° C.) fixing. Also, since the pigment of the compound (2) group was used alone, the chromaticity of the toner in the state of powder also shifted to a red tint, and consequently the reproduced images also had a color tone greatly deviating from that of process inks.

Comparative Example 3

A yellow toner 14 was prepared in substantially the same manner as in Example 1 except that the pigment of the compound (1) group was used in an amount changed to 7.5 parts and the pigment of the compound (2) group in an amount changed to 3.5 parts. A yellow developer 14 was obtained in the same way. The formulation of the toner is shown in Table 3. A list of the results of measurement of physical properties and results of evaluation is shown as Table 4.

In the yellow toner 14 the pigment ratio of the pigment of the compound (2) group to the pigment of the compound (1) group was so large that relatively the chromaticity of the toner in the state of powder also shifted to a red tint, and consequently the reproduced images also had a color tone greatly deviating from that of process inks.

Comparative Example 4

A yellow toner 15 was prepared in substantially the same manner as in Example 1 except that the pigment of the compound (1) group was used in an amount changed to 7.5 parts and the pigment of the compound (2) group was changed for C.I. Pigment Yellow 110 (4.0 parts). A yellow developer 15 was obtained in the same way. The formulation of the toner is shown in Table 3. A list of the results of measurement of physical properties and results of evaluation is shown as Table 4.

In the yellow toner 15 the pigment ratio of the pigment of the compound (2) group to the pigment of the compound (1) group was so large that relatively the chromaticity of the toner in the state of powder also shifted to a red tint, and consequently the reproduced images also had a color tone greatly deviating from that of process inks.

Comparative Example 5

A yellow toner 16 was prepared in substantially the same manner as in Example 1 except that the pigment of the compound (2) group was changed for C.I. Pigment Yellow 139 (3.5 parts). A yellow developer 16 was obtained in the same way. The formulation of the toner is shown in Table 3. A list of the results of measurement of physical properties and results of evaluation is shown as Table 4.

In the yellow toner 16 the pigment ratio of the pigment of the compound (2) group to the pigment of the compound (1) group was so large that relatively the chromaticity of the toner in the state of powder also shifted to a red tint, and consequently the reproduced images also had a- color tone greatly deviating from that of process inks.

Reference Example 1

A yellow toner 17 was prepared in substantially the same manner as in Example 1 except that the pigment of the compound (1) group was used in an amount changed to 4.0 parts, the pigment of the compound (2) group was used in an amount changed to 1.8 parts and the wax was not added at all. A yellow developer 17 was obtained in the same way. The formulation of the toner is shown in Table 3. A list of the results of measurement of physical properties and results of evaluation is shown as Table 4.

In the yellow toner 17 the pigment of the compound (1) group and the pigment of the compound (2) group were in so small total content as to cause the problem that the image density was low. Also, since any wax was not used, the fixing temperature region came greatly narrow.

Reference Example 2

A yellow toner 18 was prepared in substantially the same manner as in Example 1 except that the pigment of the compound (1) group was used in an amount changed to 3.0 parts, the pigment of the compound (2) group was used in an amount changed to 1.0 part and the wax (A) was changed for the wax (E). A yellow developer 18 was obtained in the same way. The formulation of the toner is shown in Table 3. A list of the results of measurement of physical properties and results of evaluation is shown as Table 4.

In the yellow toner 18 the pigment of the compound (1) group and the pigment of the compound (2) group were in so small total content as to cause the problem that the image density was low. Also,. the wax (E) had so high a melting point that the wax did not effectively exude to the nip of the fixing rollers, and hence the fixing temperature region came greatly narrow.

Reference Example 3

A yellow toner 19 was prepared in substantially the same manner as in Example 1 except that the pigment of the compound (1) group was used in an amount changed to 4.0 parts and the pigment of the compound (2) group was changed for C.I. Pigment Yellow 110 (0.5 part). A yellow developer 19 was obtained in the same way. The formulation of the toner is shown in Table 3. A list of the results of measurement of physical properties and results of evaluation is shown as Table 4.

Reference Example 4

A yellow toner 20 was prepared in substantially the same manner as in Example 1 except that the pigment of the compound (1) group was used in an amount changed to 12.0 parts and the pigment of the compound (2) group in an amount changed to 3.5 parts. A yellow developer 20 was obtained in the same way. The formulation of the toner is shown in Table 3. A list of the results of measurement of physical properties and results of evaluation is shown as Table 4.

In the yellow toner 20 the pigment of the compound (1) group and the pigment of the compound (2) group were in so large total content that, though the image density was sufficient, the chroma was poor and shifted inevitably to a red tint in the region of high density, and consequently the reproduced images also had a color tone greatly deviating from that of process inks.

Reference Example 5

A yellow toner 21 was prepared in substantially the same manner as in Example 1 except that the pigment of the compound (1) group was changed for C.I. Pigment Yellow 17 (16 parts) and the pigment of the compound (2) group was changed for C.I. Pigment Yellow 110 (1.0 parts). A yellow developer 21 was obtained in the same way. The formulation of the toner is shown in Table 3. A list of the results of measurement of physical properties and results of evaluation is shown as Table 4.

Example 12

A cyan toner 1 was prepared in substantially the same manner as in Example 1 except that in place of the pigment of the compound (1) group C.I. Pigment Blue 15:3 (4.0 parts) was used as the pigment of the compound (3) group and in place of the pigment of the compound (.2) group C.I. Pigment Green 7 (0.25 part) was used as the pigment of the compound (4) group. A cyan developer 1 was obtained in the same way. The formulation of the toner is shown in Table 5. A list of the results of measurement of physical properties and results of evaluation is shown as Table 6.

Example 13

A cyan toner 2 was prepared in substantially the same manner as in Example 12 except that in place of the hybrid resin Resin (1) the hybrid resin Resin (2) was used and the pigment of the compound (4) group was used in an amount changed to 0.4 part. A cyan developer 2 was obtained in the same way. The formulation of the toner is shown in Table 5. A list of the results of measurement of physical properties and results of evaluation is shown as Table 6.

Example 14

A cyan toner 3 was prepared in substantially the same manner as in Example 12 except that in place of the hybrid resin Resin (1) the hybrid resin Resin (3) was used and the pigment of the compound (4) group was used in an amount changed to 0.1 part. A cyan developer 3 was obtained in the same way. The formulation of the toner is shown in Table 5. A list of the results of measurement of physical properties and results of evaluation is shown as Table 6.

Example 15

A cyan toner 4 was prepared in substantially the same manner as in Example 12 except that in place of the hybrid resin Resin (1) the polyester resin Resin (5) was used, the pigment of the compound (3) group was used in an amount changed to 5.0 parts and the pigment of the compound (4) group was used in an amount changed to 0.5 part. A cyan developer 4 was obtained in the same way. The formulation of the toner is shown in Table 5. A list of the results of measurement of physical properties and results of evaluation is shown as Table 6.

Example 16

A cyan toner 5 was prepared in substantially the same manner as in Example 12 except that in place of the hybrid resin Resin (1) the vinyl resin Resin (7) was used, the pigment of the compound (3) group was used in an amount changed to 6.0 parts and the pigment of the compound (4) group was used in an amount changed to 0.2 part. A cyan developer 5 was obtained in the same way. The formulation of the toner is shown in Table 5. A list of the results of measurement of physical properties and results of evaluation is shown as Table 6.

Example 17

A cyan toner 6 was prepared in substantially the same manner as in Example 12 except that the pigment of the compound (3) group was changed for C.I. Pigment Blue 15:4 (4.0 parts) and the wax (A) used was changed for the wax (B). A cyan developer 6 was obtained in the same way. The formulation of the toner is shown in Table 5. A list of the results of measurement of physical properties and results of evaluation is shown as Table 6.

Example 18

A cyan toner 7 was prepared in substantially the same manner as in Example 12 except that the wax (A) used was changed for the wax (D). A cyan developer 7 was obtained in the same way. The formulation of the toner is shown in Table 5. A list of the results of measurement of physical properties and results of evaluation is shown as Table 6.

Example 19

A cyan toner 8 was prepared in substantially the same manner as in Example 12 except that the wax (A) used was changed for the wax (C). A cyan developer 8 was obtained in the same way. The formulation of the toner is shown in Table 5. A list of the results of measurement of physical properties and results of evaluation is shown as Table 6.

Comparative Example 6

A cyan toner 9 was prepared in substantially the same manner as in Example 12 except that a single-pigment system was employed in which the pigment of the compound (4) group was not used at all. A cyan developer 9 was obtained in the same way. The formulation of the toner is shown in Table 5. A list of the results of measurement of physical properties and results of evaluation is shown as Table 6.

The cyan toner 9 was composed of a resin having a large value of Mw/Mn, so that the G' at 80° C. was also so large that the toner came very hard. Also, because of the single-pigment system in which the pigment of the compound (4) group was not used in combination, the chromaticity of the toner in the state of powder also shifted too much to a blue tint, and consequently the reproduced images also had a color tone greatly deviating from that of process inks.

Comparative Example 7

A cyan toner 10 was prepared in substantially the same manner as in Example 12 except that in place of the hybrid resin Resin (1) the polyester resin Resin (6) was used,.the pigment of the compound (3) group was not used at all and C.I. Pigment Green 7 of the compound (4) group was used alone in n amount of 4.0 parts. A cyan developer 10 was obtained in the same way. The formulation of the toner is shown in Table 5. A list of the results of measurement of physical properties and results of evaluation is shown as Table 6.

The cyan toner 10 was composed of a resin having a small value of Mw/Mn, so that the G' at 80° C. also showed a small value and, in the fixing test, the transfer paper wound around the upper roller at low-temperature (140° C.) fixing. Also, since the pigment of the compound (4) group was used alone, the chromaticity of the toner in the state of powder also shifted to a green tint, and consequently the reproduced images also had a color tone greatly deviating from that of process inks.

Comparative Example 8

A cyan toner 11 was prepared in substantially the same manner as in Example 12 except that the pigment of the compound (4) group was changed for C.I. Pigment Green 36. A cyan developer 11 was obtained in the same way. The formulation of the toner is shown in Table 5. A list of the results of measurement of physical properties and results of evaluation is shown as Table 6.

Since the cyan toner 11 made use of the strongly negatively chargeable C.I. Pigment Green 36, it was unstable in charge maintenance performance to cause a great lowering of image density in the running test. Also, consequently the reproduced images had a color tone greatly deviating from that of process inks.

Comparative Example 9

A cyan toner 12 was prepared in substantially the same manner as in Example 12 except that the pigment of the compound (4) group was used in an amount changed to 0.5 part. A cyan developer 12 was obtained in the same way. The formulation of the toner is shown in Table 5. A list of the results of measurement of physical properties and results of evaluation is shown as Table 6.

In the cyan toner 12 the pigment ratio of the pigment of the compound (4) group to the pigment of the compound (3) group was so large that relatively the chromaticity of the toner in the state of powder also shifted too much to a green tint, and consequently the reproduced images also had a color tone greatly deviating from that of process inks.

Comparative Example 10

A cyan toner 13 was prepared in substantially the same manner as in Example 12 except that the pigment of the compound (3) group was changed for C.I. Pigment Blue 15:4 (3.5 parts), the pigment of the compound (4) group was used in an amount changed to 0.5 part and the wax was not added at all. A cyan developer 13 was obtained in the same way. The formulation of the toner is shown in Table 5. A list of the results of measurement of physical properties and results of evaluation is shown as Table 6.

In the cyan toner 13 the pigment ratio of the pigment of the compound (4) group to the pigment of the compound (3)

group was so large that relatively the chromaticity of the toner in the state of powder also shifted too much to a green tint, and consequently the reproduced images also had a color tone greatly deviating from that of process inks.

Reference Example 6

A cyan toner 14 was prepared in substantially the same manner as in Example 12 except that the pigment of the compound (3) group was used in an amount changed to 8.0 parts, the pigment of the compound (4) group in an amount changed to 0.4 parts and the wax (A) used was changed for the wax (E). A cyan developer 14 was obtained in the same way. The formulation of the toner is shown in Table 5. A list of the results of measurement of physical properties and results of evaluation is shown as Table 6.

In,the cyan toner 14 the pigment of the compound (3) group and the pigment of the compound (4) group were in so large total content that, though the image density was sufficient, the chroma was poor and shifted inevitably to a blue tint in the region of high density, and consequently the reproduced images also had a color tone greatly deviating from that of process inks. Also, the wax (E) had so high a melting point that the wax did not effectively exude to the nip of the fixing rollers, and hence the fixing temperature region came greatly narrow.

Reference Example 7

A cyan toner 15 was prepared in substantially the same manner as in Example 12 except that the pigment of the compound (3) group was used in an amount changed to 2.5 parts and the pigment of the compound (4) group was used in an amount changed to 0.2 part. A cyan developer 15 was obtained in the same way. The formulation of the toner is shown in Table 5. A list of the results of measurement of physical properties and results of evaluation is shown as Table 6.

In the cyan toner 15 the pigment of the compound (3) group and the pigment of the compound (4) group were in so small total content as to cause the problem that the image density was low.

Example 20

A magenta toner 1 was prepared in substantially the same manner as in Example 1 except that in place of the pigment of the compound (1) group C.I. Pigment Red 57:1 (6.0 parts) was used as the pigment of the compound (5) group and in place of the pigment of the compound (2) C.I. Pigment Red 122 (1.5 parts) was used as the pigment of the compound (6) group. A magenta developer 1 was obtained in the same way. The formulation of the toner is shown in Table 7. A list of the results of measurement of physical properties and results of evaluation is shown as Table 8.

Example 21

A magenta toner 2 was prepared in substantially the same manner as in Example 20 except that in place of the hybrid resin Resin (1) the hybrid resin Resin (2) was used, the pigment of the compound (5) group was used in an amount changed to 5.0 parts and the pigment of the compound (6) group was used in an amount changed to 1.0 part. A magenta developer 2 was obtained in the same way. The formulation of the toner is shown in Table 7. A list of the results of measurement of physical properties and results of evaluation is shown as Table 8.

Example 22

A magenta toner 3 was prepared in substantially the same manner as in Example 20 except that in place of the hybrid resin Resin (1) the hybrid resin Resin (3) was used, the pigment of the compound (5) group was used in an amount changed to 5.0 parts and the pigment of the compound (6) group was used in an amount changed to 2.0 parts. A magenta developer 3 was obtained in the same way. The formulation of the toner is shown in Table 7. A list of the results of measurement of physical properties and results of evaluation is shown as Table 8.

Example 23

A magenta toner 4 was prepared in substantially the same manner as in Example 20 except that in place of the hybrid resin Resin (1) the polyester resin Resin (5) was used, the pigment of the compound (5) group was changed for C.I. Pigment Red 5 (7.0 parts) and the pigment of the compound (6) group was used in an amount changed to 3.0 parts. A magenta developer 4 was obtained in the same way. The formulation of the toner is shown in Table 7. A list of the results of measurement of physical properties and results of evaluation is shown as Table 8.

Example 24

A magenta toner 5 was prepared in substantially the same manner as in Example 20 except that in place of the hybrid resin Resin (1) the vinyl resin Resin (7) was used and the pigment of the compound (5) group was changed for C.I. Pigment Red 146 (5.0 parts). A magenta developer 5 was obtained in the same way. The formulation of the toner is shown in Table 7. A list of the results of measurement of physical properties and results of evaluation is shown as Table 8.

Example 25

A magenta toner 6 was prepared in substantially the same manner as in Example 20 except that the pigment of the compound (5) group was changed for C.I. Pigment Red 238 (6.0 parts), the pigment of the compound (6) group was used in an amount changed to 0.5 part and the wax (A) used was changed for the wax (B). A magenta developer 6 was obtained in the same way. The formulation of the toner is shown in Table 7. A list of the results of measurement of physical properties and results of evaluation is shown as Table 8.

Example 26

A magenta toner 7 was prepared in substantially the same manner as in Example 20 except that the pigment of the compound (5) group was changed for C.I. Pigment Red 254 (6.0 parts), the pigment of the compound (6) group was used in an amount changed to 2.5 parts and the wax (A) used was changed for the wax (D). A magenta developer 7 was obtained in the same way. The formulation of the toner is shown in Table 7. A list of the results of measurement of physical properties and results of evaluation is shown as Table 8.

Example 27

A magenta toner 8 was prepared in substantially the same manner as in Example 20 except that the pigment of the compound (5) group was changed for C.I. Pigment Violet 19 (6.0 parts), the pigment of the compound (6) group was used in an amount changed to 2.5 parts and the wax (A) used was changed for the wax (C). A magenta developer 8 was obtained in the same way. The formulation of the toner is shown in Table 7. A list of the results of measurement of physical properties and results of evaluation is shown as Table 8.

Comparative Example 11

A magenta toner 9 was prepared in substantially the same manner as in Example 20 except that a single-pigment system was employed in which the pigment of the compound (6) group was not used at all. A magenta developer 9 was obtained in the same way. The formulation of the toner is shown in Table 7. A list of the results of measurement of physical properties and results of evaluation is shown as Table 8.

The magenta toner 9 was composed of a resin having a large value of Mw/Mn, so that the G' at 80° C. was also so large that the toner came very hard. Also, because of the single-pigment system in which the pigment of the compound (6) group was not used in combination, the chromaticity of the toner in the state of powder also shifted too much to a red tint, and consequently the reproduced images also had a color tone greatly deviating from that of process inks.

Comparative Example 12

A magenta toner 10 was prepared in substantially the same manner as in Example 20 except that in place of the hybrid resin Resin (1) the polyester resin Resin (6) was used, the pigment of the compound (5) group was not used at all and C.I. Pigment Red 122 of the compound (6) group was used alone in an amount of 6.0 parts. A magenta developer 10 was obtained in the same way. The formulation of the toner is shown in Table 7. A list of the results of measurement of physical properties and results of evaluation is shown as Table 8.

The magenta toner 10 was composed of a resin having a small value of Mw/Mn, so that the G' at 120 to 180° C. also showed a small value and, in the fixing test, the transfer paper wound around the upper roller at low-temperature (140° C.) fixing. Also, since the pigment of the compound (6) group was used alone, the chromaticity of the toner in the state of powder also shifted to a blue tint, and consequently the reproduced images also had a color tone greatly deviating from that of process inks.

Comparative Example 13

A magenta toner 11 was prepared in substantially the same manner as in Example 20 except that the pigment of the compound (5) group was used in an amount changed to 5.5 parts and the pigment of the compound (6) group was used in an amount changed to 5.5 parts. A magenta developer 11 was obtained in the same way. The formulation of the toner is shown in Table 7. A list of the results of measurement of physical properties and results of evaluation is shown as Table 8.

In the magenta toner 11 the pigment ratio of the pigment of the compound (6) group to the pigment of the compound (5) group was so large that relatively the chromaticity of the toner in the state of powder also shifted too much to a blue tint, and consequently the reproduced images also had a color tone greatly deviating from that of process inks.

Comparative Example 14

A magenta toner 12 was prepared in substantially the same manner as in Example 20 except that the pigment of the compound (5) group was changed for C.I. Pigment Red 5 (5.0 parts) and the pigment of the compound (6) group was used in an amount changed to 3.0 parts. A magenta developer 12 was obtained in the same way. The formulation of the toner is shown in Table 7. A list of the results of measurement of physical properties and results of evaluation is shown as Table 8.

In the magenta toner 12 the pigment-ratio of the pigment of the compound (6) group to the pigment of the compound (5) group was so large that relatively the chromaticity of the toner in the state of powder also shifted too much to a blue tint, and consequently the reproduced images also had a color tone greatly deviating from that of process inks.

Reference Example 8

A magenta toner 13 was prepared in substantially the same manner as in Example 20 except that the pigment of the compound (5) group was used in an amount changed to 3.0 parts and the pigment of the compound (6) group was used in an amount changed to 0.5 part. A magenta developer 13 was obtained in the same way. The formulation of the toner is shown in Table 7. A list of the results of measurement of physical properties and results of evaluation is shown as Table 8.

In the magenta toner 13 the pigment of the compound (5) group and the pigment of the compound (6) group were in so small total content as to cause the problem that the image density was low. Also, reproduced images having no chroma and being commonplace were formed.

Comparative Example 15

A magenta toner 14 was prepared in substantially the same manner as in Example 20 except that the pigment of the compound (5) group was used in an amount changed to 1.5 parts and the pigment of the compound (6) group was used in an amount changed to 1.0 part and the wax (A) used was changed for the wax (E). A magenta developer 14 was obtained in the same way. The formulation of the toner is shown in Table 7. A list of the results of measurement of physical properties and results of evaluation is shown as Table 8.

In the magenta toner 14 the pigment of the compound (5) group and the pigment of the compound. (6) group were in so small total content as to cause the problem that the image density was low. Also, reproduced images having no chroma and being commonplace were formed.

Reference Example 9

A magenta toner 15 was prepared in substantially the same manner as in Example 20 except that the pigment of the compound (5) group was used in an amount changed to 8.0 parts and the pigment of the compound (6) group was used in an amount changed to 2.5 parts. A magenta developer 15 was obtained in the same way. The formulation of the toner is shown in Table 7. A list of the results of measurement of physical properties and results of evaluation is shown as Table 8.

In the magenta toner 15 the pigment of the compound (5) group and the pigment of the compound (6) group were in so large total content that, though the image density was sufficient, the chroma was poor and shifted inevitably to a red tint in the region of high density, and consequently the reproduced images also had a color tone greatly deviating from that of process inks.

Reference Example 10

A magenta toner 16 was prepared in substantially the same manner as in Example 20 except that the pigment of the compound (5) group was used in an amount changed to 9.0 parts and the pigment of the compound (6) group was used in an amount changed to 1.5 parts. A magenta developer 16 was obtained in the same way. The formulation of the toner is shown in Table 7. A list of the results of measurement of physical properties and results of evaluation is shown as Table 8.

In the magenta toner 16 the pigment of the compound (5) group and the pigment of the compound (6) group were in so large total content that, though the image density was sufficient, the chroma was poor and shifted inevitably to a red tint in the region of high density, and consequently the reproduced images also had a color tone greatly deviating from that of process inks.

Example 28

Images were reproduced using the yellow toner 1 and the cyan toner 1, and the chromaticity of secondary-color green was measured. As the result, a* was −70.5 and b* was 22.9, which were substantially in agreement with the hue of green of process inks, and images satisfactory in all the chroma, the image density and the OHT transparency were obtained.

Example 29

Images were reproduced using the yellow toner 1 and the magenta toner 1, and the chromaticity of secondary-color red was measured. As the result, a* was 67.5 and b* was 45.0, which were substantially in agreement with the hue of red of process inks, and images satisfactory in all the chroma, the image density and the OHT transparency were obtained.

Example 30

Images were reproduced using the cyan toner 1 and the magenta toner 1, and the chromaticity of secondary-color blue was measured. As the result, a* was 22.3 and b* was −49.3, which were substantially in agreement with the hue of blue of process inks, and images satisfactory in all the chroma, the image density and the OHT transparency were obtained.

Example 31

Using the magenta toner 1, the yellow toner 1 and the cyan toner 1 in the commercially available full-color copying machine CLC-800 used in Example 1, an unfixed full-color image was formed and fixed onto a recording material to obtain a full-color fixed image. Evaluation was made on the image thus obtained. The evaluation results were good and particularly showed excellent pale color reproducibility.

Comparative Example 16

Images were reproduced using the yellow toner 1 and the cyan toner 9, and the chromaticity of secondary-color green was measured. As the result, a* was −60.9 and b* was 23.6, which deviated greatly from the hue of green of process inks.

Comparative Example 17

Images were reproduced using the yellow toner 1 and the magenta toner 10, and the chromaticity of secondary-color red was measured. As the result, a* was 72.1 and b* was 36.3, which deviated greatly from the hue of red of process inks.

Comparative Example 18

Images were reproduced using the cyan toner 13 and the magenta toner 1, and the chromaticity of secondary-color blue was measured. As the result, a* was −6.2 and b* was −50.1, which deviated greatly from the hue of blue of process inks.

Comparative Example 19

Where images were reproduced using the yellow toner 1 and the cyan toner 11, the reproducibility of secondary-color green was able to be well ensured. However, even when the most blue-tinged magenta toner 4 was used in combination with the cyan toner 11, the chroma of blue was far not equal to the blue of process inks, where a* was 22.3 and b* was −39.9.

Comparative Example 20

Where images were reproduced using the yellow toner 1 and the magenta toner 11, the reproducibility of secondary-color red was able to be well ensured. However, even when the most blue-tinged cyan toner 3 was used in combination with the magenta toner 11, the chroma of blue was far not equal to the blue of process inks, where, a* was 24.2 and b* was −38.2.

TABLE 3

| | | | Compound (1) | | Compound (2) | | | |
|---|---|---|---|---|---|---|---|---|
| | Yellow Toner | Resin | Kind | Amt. (pbw) | Kind | Amt. (pbw) | Compounds (1)/(2) weight ratio | Wax |
| Example: | | | | | | | | |
| 1 | 1 | (1) | PY.155 | 8.0 | PY.147 | 1.5 | 84/16 | (A) |
| 2 | 2 | (2) | PY.155 | 8.0 | PY.110 | 0.5 | 94/6 | (A) |
| 3 | 3 | (3) | PY.155 | 8.0 | PY.139 | 1.0 | 89/11 | (A) |
| 4 | 4 | (5) | PY.155 | 10.0 | PY.110 | 0.2 | 98/2 | (A) |

TABLE 3-continued

| | Yellow Toner | Resin | Compound (1) Kind | Compound (1) Amt. (pbw) | Compound (2) Kind | Compound (2) Amt. (pbw) | Compounds (1)/(2) weight ratio | Wax |
|---|---|---|---|---|---|---|---|---|
| 5 | 5 | (7) | PY.155 | 8.0 | PY.147 | 3.0 | 63/27 | (A) |
| 6 | 6 | (1) | PY.17 | 7.0 | PY.147 | 1.3 | 84/16 | (B) |
| 7 | 7 | (1) | PY.62 | 12.0 | PY.147 | 1.0 | 92/8 | (D) |
| 8 | 8 | (2) | PY.74 | 7.0 | PY.147 | 0.7 | 91/9 | (C) |
| 9 | 9 | (2) | PY.93 | 8.0 | PY.147 | 0.8 | 91/9 | (A) |
| 10 | 10 | (1) | PY.97 | 8.0 | PY.147 | 0.7 | 92/8 | (A) |
| 11 | 11 | (1) | PY.168 | 11.0 | PY.147 | 1.2 | 90/10 | (A) |
| Comparative Example: | | | | | | | | |
| 1 | 12 | (4) | PY.155 | 8.0 | — | — | — | (A) |
| 2 | 13 | (6) | — | — | PY.147 | 6.0 | — | (A) |
| 3 | 14 | (1) | PY.155 | 7.5 | PY.147 | 3.5 | 68/32 | (A) |
| 4 | 15 | (1) | PY.155 | 7.5 | PY.110 | 4.0 | 65/35 | (A) |
| 5 | 16 | (1) | PY.155 | 8.0 | PY.139 | 3.5 | 69/31 | (A) |
| Reference Example: | | | | | | | | |
| 1 | 17 | (1) | PY.155 | 4.0 | PY.147 | 0.8 | 83/17 | — |
| 2 | 18 | (1) | PY.155 | 3.0 | PY.147 | 1.0 | 75/25 | (E) |
| 3 | 19 | (1) | PY.155 | 4.0 | PY.110 | 0.5 | 89/11 | (A) |
| 4 | 20 | (1) | PY.155 | 12 | PY.147 | 3.5 | 77/23 | (A) |
| 5 | 21 | (1) | PY.17 | 16 | PY.110 | 1.0 | 94/6 | (A) |

TABLE 4

| | Yellow toner | Spectral sensitivity Reflectance at: 500 nm (%) | Spectral sensitivity Reflectance at: 600 nm (%) | Storage elastic modulus G' (80° C.) (dN/m$^2$) | Loss intercept tanδ (140° C.) | Endothermic peak (° C.) | Fixing temperature range Start temp. (° C.) | Fixing temperature range Offset temp. (° C.) | (1) | (2) | (3) | (4) | (5) |
|---|---|---|---|---|---|---|---|---|---|---|---|---|---|
| Example: | | | | | | | | | | | | | |
| 1 | 1 | 17.2 | 77.4 | $5.2 \times 10^6$ | 0.56 | 73.5 | 120 | 220 | A | A | A | A | A |
| 2 | 2 | 15.8 | 75.1 | $5.8 \times 10^6$ | 0.54 | 73.4 | 120 | 210 | A | A | A | A | A |
| 3 | 3 | 16.8 | 76.0 | $4.4 \times 10^6$ | 0.58 | 73.5 | 120 | 210 | A | A | A | A | A |
| 4 | 4 | 18.4 | 75.6 | $9.2 \times 10^9$ | 0.25 | 74.2 | 120 | 230 | A | A | B | A | A |
| 5 | 5 | 15.5 | 76.9 | $7.3 \times 10^6$ | 0.44 | 71.4 | 120 | 180 | A | A | B | A | B |
| 6 | 6 | 18.6 | 77.7 | $8.4 \times 10^6$ | 0.42 | 72.4 | 130 | 210 | A | A | A | A | A |
| 7 | 7 | 17.2 | 78.2 | $7.0 \times 10^7$ | 0.33 | 102.1 | 130 | 200 | A | A | A | A | B |
| 8 | 8 | 16.6 | 76.3 | $3.3 \times 10^6$ | 0.56 | 62.1 | 130 | 190 | A | A | B | A | A |
| 9 | 9 | 18.0 | 77.1 | $6.7 \times 10^6$ | 0.54 | 108 | 140 | 200 | A | A | B | A | A |
| 10 | 10 | 19.6 | 79.8 | $3.8 \times 10^6$ | 0.66 | 73.4 | 120 | 190 | A | A | A | A | B |
| 11 | 11 | 15.9 | 78.8 | $3.4 \times 10^6$ | 0.66 | 73.4 | 110 | 190 | A | A | A | B | B |
| Comparative Example: | | | | | | | | | | | | | |
| 1 | 12 | 20.3 | 80.3 | $3.0 \times 10^8$ | 0.22 | 72.5 | 160 | 200 | C | A | C | A | A |
| 2 | 13 | 3.2 | 60.3 | $2.2 \times 10^6$ | 1.75 | 73.5 | 120 | 150 | C | A | A | A | C |
| 3 | 14 | 4.2 | 65.3 | $4.0 \times 10^6$ | 0.18 | 72.6 | 170 | 220 | C | C | B | A | A |
| 4 | 15 | 2.6 | 64.0 | $5.2 \times 10^6$ | 0.54 | 73.6 | 120 | 190 | C | B | A | A | B |
| 5 | 16 | 3.8 | 66.5 | $4.9 \times 10^6$ | 0.61 | 73.4 | 120 | 180 | C | A | A | C | A |
| Reference Example: | | | | | | | | | | | | | |
| 1 | 17 | 15.6 | 77.2 | $6.0 \times 10^6$ | 0.56 | — | 150 | 170 | A | A | A | A | A |
| 2 | 18 | 16.6 | 77.2 | $6.0 \times 10^6$ | 0.55 | 115.1 | 160 | 170 | B | B | B | B | C |
| 3 | 19 | 17.2 | 79.1 | $5.3 \times 10^6$ | 0.54 | 73.5 | 130 | 210 | B | B | C | B | B |
| 4 | 20 | 16.5 | 76.0 | $6.1 \times 10^6$ | 0.56 | 76.5 | 140 | 180 | C | B | C | B | B |
| 5 | 21 | 17.6 | 75.5 | $7.2 \times 10^6$ | 0.55 | 74.2 | 150 | 170 | C | C | C | B | B |

(1): $_{\Delta}E$ to process inks; (2): Charging stability; (3): OHP tranparency; (4): Light-fastness; (5): Anti-blocking properties

TABLE 5

| | Cyan toner | Resin | Compound (3) Kind | Compound (3) Amt. (pbw) | Compound (4) Kind | Compound (4) Amt. (pbw) | Compounds (3)/(4) weight ratio | Wax |
|---|---|---|---|---|---|---|---|---|
| Example: | | | | | | | | |
| 12 | 1 | (1) | PB.15:3 | 4.0 | PG.7 | 0.25 | 94/6 | (A) |
| 13 | 2 | (2) | PB.15:3 | 4.0 | PG.7 | 0.4 | 91/9 | (A) |
| 14 | 3 | (3) | PB.15:3 | 4.0 | PG.7 | 0.1 | 98/2 | (A) |
| 15 | 4 | (5) | PB.15:3 | 5.0 | PG.7 | 0.5 | 91/9 | (A) |
| 16 | 5 | (7) | PB.15:3 | 6.0 | PG.7 | 0.2 | 97/3 | (A) |
| 17 | 6 | (1) | PB.15:4 | 4.0 | PG.7 | 0.25 | 94/6 | (B) |
| 18 | 7 | (1) | PB.15:3 | 4.0 | PG.7 | 0.25 | 94/6 | (D) |
| 19 | 8 | (2) | PB.15:3 | 4.0 | PG.7 | 0.25 | 94/6 | (C) |
| Comparative Example: | | | | | | | | |
| 6 | 9 | (4) | PB.15:3 | 4.0 | — | — | — | (A) |
| 7 | 10 | (6) | — | — | PG.7 | 4.0 | — | (A) |
| 8 | 11 | (1) | PB.15:3 | 4.0 | PG.36 | 0.25 | 94/6 | (A) |
| 9 | 12 | (1) | PB.15:3 | 4.0 | PG.7 | 0.5 | 89/11 | (A) |
| 10 | 13 | (1) | PB.15:4 | 3.5 | PG.7 | 0.5 | 87/13 | — |
| Reference Example: | | | | | | | | |
| 6 | 14 | (1) | PB.15:3 | 8.0 | PG.7 | 0.4 | 95/5 | (E) |
| 7 | 15 | (1) | PB.15:3 | 2.5 | PG.7 | 0.2 | 93/7 | (A) |

TABLE 6

| | Cyan toner | Spectral sensitivity Reflectance at: 450 nm (%) | Spectral sensitivity Reflectance at: 475 nm (%) | Storage elastic modulus G' (80° C.) (dN/m$^2$) | Loss inter-cept tanδ (140° C.) | Endo-ther-mic peak (° C.) | Fixing temperature range Start temp. (° C.) | Fixing temperature range Offset temp. (° C.) | (1) | (2) | (3) | (4) | (5) |
|---|---|---|---|---|---|---|---|---|---|---|---|---|---|
| Example: | | | | | | | | | | | | | |
| 12 | 1 | 32.9 | 37.6 | $5.1 \times 10^7$ | 0.55 | 73.3 | 120 | 220 | A | A | A | A | A |
| 13 | 2 | 33.0 | 36.2 | $5.7 \times 10^6$ | 0.53 | 73.1 | 130 | 210 | A | A | A | A | A |
| 14 | 3 | 34.7 | 39.8 | $4.2 \times 10^6$ | 0.59 | 73.9 | 120 | 210 | A | A | A | A | A |
| 15 | 4 | 30.3 | 35.2 | $9.1 \times 10^9$ | 0.22 | 74.0 | 120 | 220 | A | B | B | A | A |
| 16 | 5 | 32.6 | 37.5 | $7.5 \times 10^6$ | 0.41 | 71.9 | 120 | 190 | A | A | B | A | A |
| 17 | 6 | 32.8 | 37.4 | $8.5 \times 10^6$ | 0.39 | 72.9 | 140 | 210 | A | A | A | A | B |
| 18 | 7 | 33.0 | 37.5 | $6.9 \times 10^7$ | 0.29 | 103.8 | 130 | 200 | A | A | A | A | B |
| 19 | 8 | 33.2 | 37.7 | $3.1 \times 10^7$ | 0.55 | 62.5 | 130 | 180 | A | A | B | A | B |
| Comparative Example: | | | | | | | | | | | | | |
| 6 | 9 | 38.1 | 43.0 | $2.9 \times 10^8$ | 0.21 | 72.5 | 150 | 190 | C | A | C | A | A |
| 7 | 10 | 15.6 | 22.1 | $2.1 \times 10^6$ | 1.80 | 74.6 | 120 | 160 | C | A | C | A | C |
| 8 | 11 | 29.7 | 34.2 | $3.9 \times 10^6$ | 0.19 | 72.6 | 150 | 210 | B | C | B | C | B |
| 9 | 12 | 29.4 | 34.2 | $5.1 \times 10^6$ | 0.55 | 74.1 | 130 | 200 | C | B | C | B | B |
| 10 | 13 | 28.1 | 32.5 | $4.8 \times 10^6$ | 0.58 | 72.6 | 130 | 190 | C | B | C | B | A |
| Reference Example: | | | | | | | | | | | | | |
| 6 | 14 | 33.8 | 37.5 | $6.2 \times 10^6$ | 0.55 | — | 150 | 180 | B | B | C | B | A |
| 7 | 15 | 32.4 | 38.9 | $6.1 \times 10^6$ | 0.55 | 114.9 | 160 | 180 | B | B | A | B | C |

(1): $_{\Delta}E$ to process inks; (2): Charging stability; (3): OHP tranparency; (4): Light-fastness; (5): Anti-blocking properties

TABLE 7

| | Magenta toner | Resin | Compound (5) Kind | Compound (5) Amt. (pbw) | Compound (6) Kind | Compound (6) Amt. (pbw) | Compounds (5)/(6) weight ratio | Wax |
|---|---|---|---|---|---|---|---|---|
| Example: | | | | | | | | |
| 20 | 1 | (1) | PR.57:1 | 6.0 | PR.122 | 1.5 | 80/20 | (A) |
| 21 | 2 | (2) | PR.57:1 | 5.0 | PR.122 | 1.0 | 83/17 | (A) |
| 22 | 3 | (3) | PR.57:1 | 5.0 | PR.122 | 2.0 | 71/29 | (A) |
| 23 | 4 | (5) | PR.5 | 7.0 | PR.122 | 3.0 | 70/30 | (A) |
| 24 | 5 | (7) | PR.146 | 5.0 | PR.122 | 1.5 | 77/23 | (A) |
| 25 | 6 | (1) | PR.238 | 6.0 | PR.122 | 0.5 | 92/8 | (B) |
| 26 | 7 | (1) | PR.254 | 6.0 | PR.122 | 2.5 | 71/29 | (D) |
| 27 | 8 | (2) | PV.19 | 6.0 | PR.122 | 2.0 | 75/25 | (C) |
| Comparative Example: | | | | | | | | |
| 11 | 9 | (4) | PR.57:1 | 6.0 | — | — | — | (A) |
| 12 | 10 | (6) | — | — | PR.122 | 6.0 | — | (A) |
| 13 | 11 | (1) | PR.57:1 | 5.5 | PR.122 | 5.5 | 50/50 | (A) |
| 14 | 12 | (1) | PR.5 | 5.0 | PR.122 | 3.0 | 62/38 | (A) |
| Reference Example: | | | | | | | | |
| 8 | 13 | (1) | PR.57:1 | 3.0 | PR.122 | 0.5 | 86/14 | (A) |
| Comparative Example: | | | | | | | | |
| 15 | 14 | (1) | PR.57:1 | 1.5 | PR.122 | 1.0 | 60/40 | (E) |
| Reference Example: | | | | | | | | |
| 9 | 15 | (1) | PR.57:1 | 8.0 | PR.122 | 2.5 | 76/24 | (A) |
| 10 | 16 | (1) | PR.57:1 | 9.0 | PR.122 | 1.5 | 84/16 | (A) |

TABLE 8

| | Magenta toner | Spectral sensitivity Reflectance at: 425 nm (%) | Spectral sensitivity Reflectance at: 675 nm (%) | Storage elastic modulus G' (80° C.) (dN/m$^2$) | Loss intercept tanδ (140° C.) | Endothermic peak (° C.) | Fixing temperature range Start temp. (° C.) | Fixing temperature range Offset temp. (° C.) | (1) | (2) | (3) | (4) | (5) |
|---|---|---|---|---|---|---|---|---|---|---|---|---|---|
| Example: | | | | | | | | | | | | | |
| 20 | 1 | 7.4 | 67.6 | $5.2 \times 10^6$ | 0.56 | 73.9 | 120 | 220 | A | A | A | A | A |
| 21 | 2 | 7.2 | 66.9 | $5.8 \times 10^6$ | 0.54 | 73.1 | 120 | 200 | A | A | A | B | A |
| 22 | 3 | 8.8 | 68.2 | $4.4 \times 10^6$ | 0.58 | 72.9 | 120 | 210 | A | A | A | B | A |
| 23 | 4 | 9.2 | 69.2 | $9.2 \times 10^9$ | 0.25 | 73.9 | 120 | 220 | A | A | B | B | B |
| 24 | 5 | 6.6 | 68.5 | $7.3 \times 10^6$ | 0.44 | 71.6 | 130 | 190 | A | A | B | B | B |
| 25 | 6 | 5.2 | 66.2 | $8.4 \times 10^6$ | 0.42 | 71.8 | 130 | 200 | A | A | A | B | A |
| 26 | 7 | 6.8 | 67.1 | $7.0 \times 10^7$ | 0.33 | 101.9 | 120 | 210 | A | A | B | B | B |
| 27 | 8 | 5.5 | 68.3 | $3.3 \times 10^6$ | 0.56 | 63.2 | 130 | 200 | A | A | B | B | A |
| Comparative Example: | | | | | | | | | | | | | |
| 11 | 9 | 3.5 | 74.3 | $2.9 \times 10^8$ | 0.23 | 73.6 | 160 | 210 | C | A | C | B | A |
| 12 | 10 | 19.6 | 61.2 | $2.4 \times 10^6$ | 1.80 | 72.5 | 130 | 160 | C | A | A | A | C |
| 13 | 11 | 10.8 | 63.9 | $3.9 \times 10^6$ | 0.19 | 72.6 | 170 | 210 | C | C | B | A | B |
| 14 | 12 | 12.5 | 65.6 | $5.1 \times 10^6$ | 0.55 | 72.9 | 130 | 180 | C | B | A | B | B |
| Reference Example: | | | | | | | | | | | | | |
| 8 | 13 | 6.8 | 66.6 | $5.0 \times 10^6$ | 0.62 | 72.8 | 130 | 180 | C | A | A | B | B |
| Comparative Example: | | | | | | | | | | | | | |
| 15 | 14 | 4.4 | 63.3 | $6.2 \times 10^6$ | 0.57 | — | 150 | 180 | A | A | A | B | B |

TABLE 8-continued

| | Magenta toner | Spectral sensitivity Reflectance at: 425 nm (%) | 675 nm (%) | Storage elastic modulus G' (80° C.) (dN/m$^2$) | Loss inter-cept tanδ (140° C.) | Endo-ther-mic peak (° C.) | Fixing temperature range Start temp. (° C.) | Offset temp. (° C.) | (1) | (2) | (3) | (4) | (5) |
|---|---|---|---|---|---|---|---|---|---|---|---|---|---|
| Reference Example: | | | | | | | | | | | | | |
| 9 | 15 | 8.2 | 67.2 | $5.9 \times 10^6$ | 0.55 | 116.2 | 150 | 180 | B | B | B | B | C |
| 10 | 16 | 7.6 | 66.9 | $5.4 \times 10^6$ | 0.52 | 72.9 | 120 | 210 | B | B | C | B | B |

(1): $_{\Delta}E$ to process inks; (2): Charging stability; (3): OHP tranparency; (4): Light-fastness; (5): Anti-blocking properties

What is claimed is:

1. A yellow toner comprising at least a binder resin and a colorant, wherein;

in a spectral-distribution diagram in which reflectance (%) is plotted as ordinate and wavelength (nm) as abscissa, the reflectance determined for a toner in a state of powder ranges from 15% to 20% at a wavelength of 500 nm and ranges from 75% to 80% at a wavelength of 600 nm, and wherein the colorant comprises a mixture of i) a compound selected from the compound (1) group consisting of C.I. Pigment Yellow 155 and compounds represented by the following Formulas (1-1), (1-2), (1-3) and (1-4) and ii) a compound selected from the compound (2) group consisting of C.I. Pigment Yellow 110, 139 and 147, in which said i) and ii) compounds are mixed in a weight ratio of from 70:30 to 99:1, and the compounds selected from each of the compound (1) group and the compound (2) are contained in an amount of from 5 parts by weight to 15 parts by weight in total, based on 100 parts by weight of the binder resin:

(1-1)

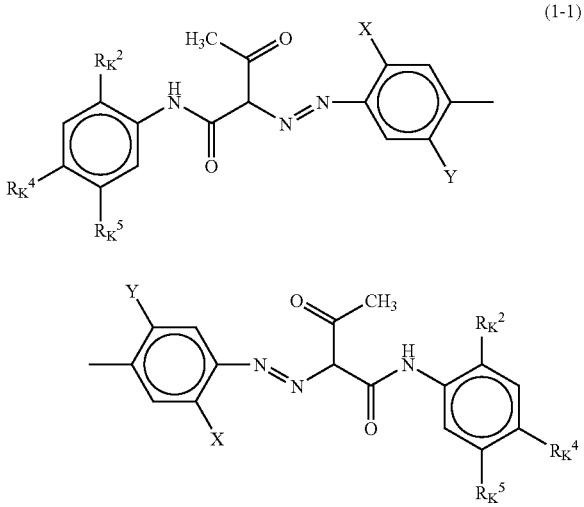

wherein X represents Cl, $CH_3$ or $OCH_3$; Y represents H or Cl; $R_K^2$ represents H, $CH_3$, $OCH_3$ or Cl; $R_K^4$ represents H, $CH_3$, Cl, $OCH_3$ or $OC_2H_5$; and $R_K^5$ represents $OCH_3$ or Cl;

(1-2)

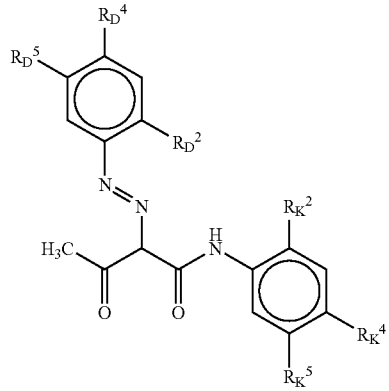

wherein $R_D^2$ represents $NO_2$, $CH_3$, $OCH_3$ or Cl; $R_D^4$ represents. $CH_3$, Cl, H, $OCH_3$ or $NO_2$; $R_D^5$ represents H or $OCH_3$; $R_K^2$ represents H, $CH_3$, Cl or $OCH_3$; $R_K^4$ represents H, $CH_3$, Cl, $OC_2H_5$ or $NHCOCH_3$; and $R_K^5$ represents $HOCH_3$ or Cl;

(1-3)

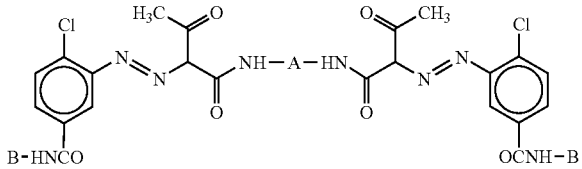

wherein A represents

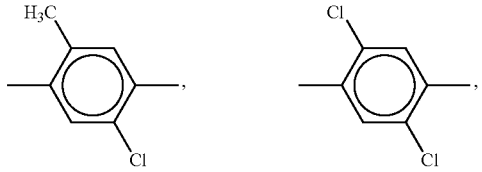

-continued

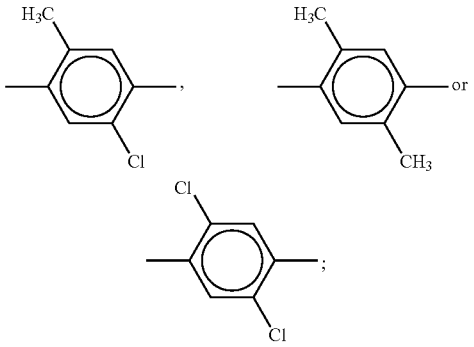

and B represents

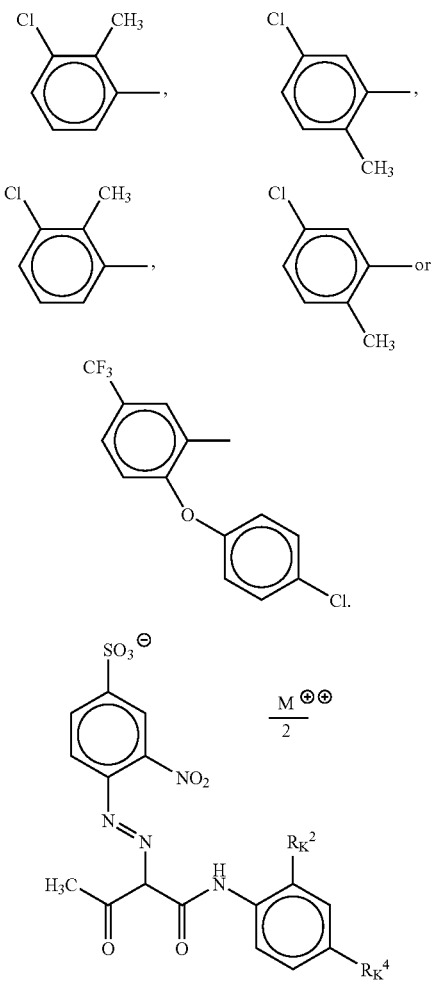

(1-4)

wherein $R_K^2$ represents H, $CH_3$ or Cl; $R_K^4$ represents H or $OCH_3$; and M represents Ca or Sr.

2. The yellow toner according to claim 1, wherein the compound of the compound (1) group is a pigment selected from C.I. Pigment Yellow 155, 17, 74, 97, 93, 62 and 168.

3. A cyan toner comprising at least a binder resin and a colorant, wherein:

in a spectral-distribution diagram in which reflectance (%) is plotted as ordinate and wavelength (nm) as abscissa, the reflectance determined for a toner in a state of powder ranges from 30% to 35% at a wavelength of 450 nm and ranges from 35% to 40% at a wavelength of 475 nm, and wherein the colorant comprises a mixture of i) a compound selected from the compound (3) group consisting of a compound represented by the following Formulas (3-1) and ii) a compound selected from the compound (4) group consisting of a compound represented by the following Formula (4-1), in which said i) and ii) compounds are mixed in a weight ratio of from 90:10 to 99:1, and the compounds selected from each of the compound (3) group and the compound (4) are contained in an amount of from 3 parts by weight to 8 parts by weight in total, based on 100 parts by weight of the binder resin:

(3-1)

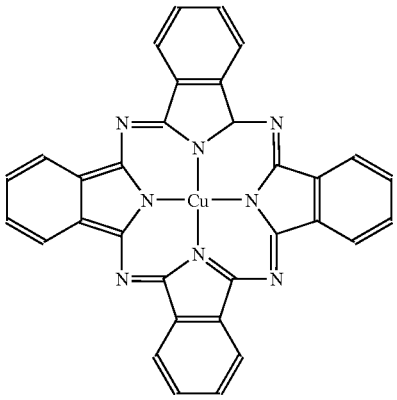

(4-1)

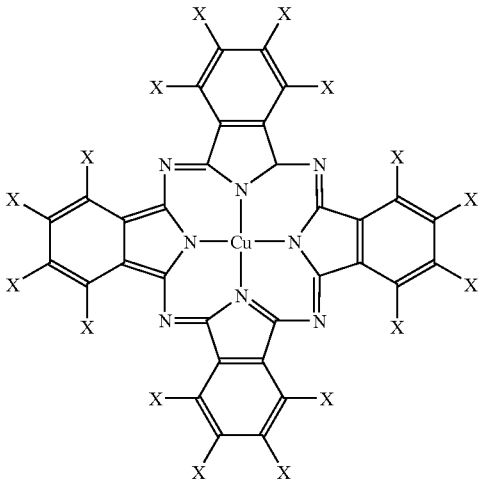

wherein X represents Cl or Br.

4. The cyan toner according to claim 3, wherein the compound of a compound (3) group is selected from C.I. Pigment Blue 15:3 and 15:4, and said compound of a compound (4) group is C.I. Pigment Green 7.

5. A magenta toner containing at least a binder resin and a colorant, wherein:

in a spectral-distribution diagram in which reflectance (%) is plotted as ordinate and wavelength (nm) as abscissa, the reflectance determined for a toner in a state of powder ranges from 5% to 10% at a wavelength of 425 nm and ranges from 65% to 70% at a wavelength of 675 nm, and wherein the colorant comprises a mixture of i) a compound selected from the compound (5) group consisting of compounds represented by the following Formulas (5-1), (5-2) and (5-3) and ii) C.I. Pigment Red 122, in which said i) and ii) compounds are mixed in a weight ratio of from 70:30 to 99:1, and the compound selected from the compound (5) group and C.I. Pigment Red 122 are contained in an amount of from 4 to 10 parts by weight in total, based on 100 parts by weight of the binder resin:

(5-1)

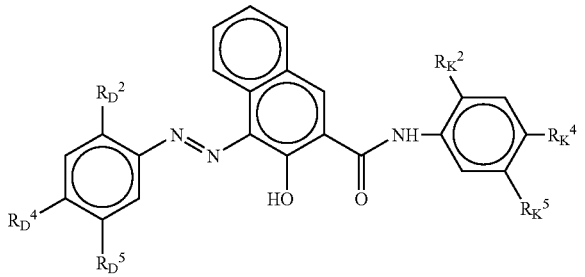

wherein $R_D^2$ represents H or $OCH_3$; $R_D^4$ represents H $CONH_2$; $R_D^5$ represents H, $SO_2N(C_2H_5)_2$, $CONHC_6H_5$, $CONHC_6H_5$, $CONH_2$ or $CONHC_6H_4$-(p) $CONH_2$; $R_K^2$ represents H, $OCH_3$, $CH_3$ or $OC_2H_5$; $R_K^4$ represents H, $OCH_3$ or Cl; and $R_K^5$ represents H, $OCH_3$, Cl or $NO_2$;

(5-2)

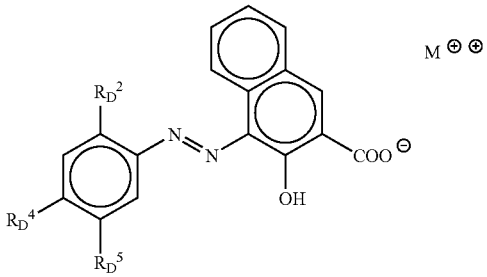

wherein $R_D^2$ represents H or $SO_3$—; $R_D^4$ represents H, Cl or $CH_3$; $R_D^5$ represents H, Cl, $CH_3$, $C_2H_5$ or $SO_3$—; and M represents Ba, Ca, Sr, Mn or Mg; provided that one of $R_D^2$ and $R_D^5$ is $SO_3$—; and (5-3)

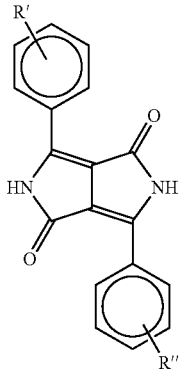

wherein R' represents H, $CH_3$, $CF_3$, Cl, Br or $N(CH_3)_2$; and R" represents $CH_3$ or $C_2H_5$).

6. The magenta toner according to claim 5, wherein the compound of the compound (5) group is a pigment selected from C.I. Pigment Violet 19 and C.I. Pigment Red 5, 146, 238, 57:1 and 254.

* * * * *

UNITED STATES PATENT AND TRADEMARK OFFICE

CERTIFICATE OF CORRECTION

PATENT NO. : 7,229,727 B2
APPLICATION NO. : 10/994344
DATED : June 12, 2007
INVENTOR(S) : Takayuki Itakura et al.

It is certified that error appears in the above-identified patent and that said Letters Patent is hereby corrected as shown below:

ON THE TITLE PAGE:

(54) Title, "TONER," should read --TONER--; and
(57) Abstract, "the." should read --the--.

COLUMN 2:

Line 30, "fixing." should read --fixing--.

COLUMN 3:

Line 41, "2,9 - dimethdylquinacridone" should read
--2,9 - dimethylquinacridone--.

COLUMN 4:

Line 2, "No. 55-048250" should read --No. 55-048250)--;
Line 29, "known have" should read --are known to have--; and
Line 52, "is" should read --are--.

COLUMN 7:

Line 18, "wherein;" should read --wherein:--;
Line 25, "wherein;" should read --wherein:--;
Line 31, "a." should read --a--;
Line 32, "wherein;" should read --wherein:--; and
Line 40, "wherein;" should read --wherein:--.

COLUMN 8:

Line 14, "wherein;" should read --wherein:--; and
Line 47, "contains" should read --contain--.

COLUMN 11:

Line 44, "$CONH_2$;." should read --$CONH_2$;--; and
Line 45, "$CONHC_6H_5$" should be deleted (duplicate).

UNITED STATES PATENT AND TRADEMARK OFFICE

CERTIFICATE OF CORRECTION

PATENT NO. : 7,229,727 B2
APPLICATION NO. : 10/994344
DATED : June 12, 2007
INVENTOR(S) : Takayuki Itakura et al.

It is certified that error appears in the above-identified patent and that said Letters Patent is hereby corrected as shown below:

COLUMN 12:

Line 21, "$C_2H_5$)." should read --$C_2H_5$.--;
Line 25, "that;" should read --that--;
Line 31, "compound (2) are" should read --compound (2) group are--; and
Line 65, "compound (2) may" should read --compound (2) group may--.

COLUMN 13:

Line 15, "compound (2) both" should read --compound (2) group both--; and
Line 26, "compound (2) in" should read --compound (2) group in--.

COLUMN 14:

Line 22, "compound (4) both" should read --compound (4) group both--;
Line 33, "compound (4) in" should read --compound (4) group in--; and
Line 50, "ad" should read --and--.

COLUMN 15:

Line 14, "using" should read --use--; and
Line 15, "compound" should read --compounds--.

COLUMN 17:

Line 12, "to 10;" should read --to 10.--;
Line 31, "ylstyrenee," should read --ylstyrene,--; and
Line 32, "p-n-hexystelene, p-n-octystyrene," should read
--p-n-hexylstyrene, p-n-octylstyrene,--.

COLUMN 19:

Line 34, "be" should read --been--.

COLUMN 22:

Line 34, "bases" should read --basis--.

UNITED STATES PATENT AND TRADEMARK OFFICE

CERTIFICATE OF CORRECTION

PATENT NO. : 7,229,727 B2
APPLICATION NO. : 10/994344
DATED : June 12, 2007
INVENTOR(S) : Takayuki Itakura et al.

It is certified that error appears in the above-identified patent and that said Letters Patent is hereby corrected as shown below:

COLUMN 24:

Line 50, “form” should read --from--.

COLUMN 32:

Line 59, (Close up space.); and
Line 60, “¶ Pigment” should read --Pigment--.

COLUMN 35:

Line 9, “a-” should read --a--; and
Line 43, “Also,.” should read --Also,--.

COLUMN 36:

Line 30, “compound (.2)” should read --compound (2)--.

COLUMN 38:

Line 5, “used, .the” should read --used, the--; and
Line 8, “n” should read --an--.

COLUMN 39:

Line 16, “In, the” should read --In the--.

COLUMN 42:

Line 56, “compound.” should read --compound--.

COLUMN 51:

Line 20, “wherein;” should read --wherein:--

COLUMN 52:

Line 39, “sents.” should read --sents--.

UNITED STATES PATENT AND TRADEMARK OFFICE

CERTIFICATE OF CORRECTION

PATENT NO. : 7,229,727 B2
APPLICATION NO. : 10/994344
DATED : June 12, 2007
INVENTOR(S) : Takayuki Itakura et al.

It is certified that error appears in the above-identified patent and that said Letters Patent is hereby corrected as shown below:

COLUMN 53:

Line 37, “ 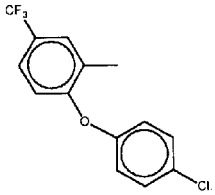 ” should read -- 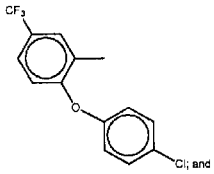 --; and

Line 50, “ 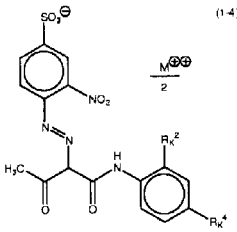 (1-4) ” should read -- 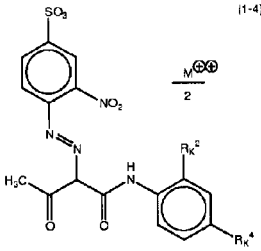 (1-4) --.

COLUMN 54:

Line 7, “Formulas” should read --Formula--; and
Line 14, “pound (4) are” should read --pound (4) group are--.

COLUMN 55:

Line 39, “represents H” (second occurrence) should read --represents H or--; and
Line 41, “$CONHC_6H_5$,” should be deleted (duplicate).

UNITED STATES PATENT AND TRADEMARK OFFICE

CERTIFICATE OF CORRECTION

PATENT NO. : 7,229,727 B2
APPLICATION NO. : 10/994344
DATED : June 12, 2007
INVENTOR(S) : Takayuki Itakura et al.

It is certified that error appears in the above-identified patent and that said Letters Patent is hereby corrected as shown below:

COLUMN 56:

Line 38, "$C_2H_5$)." should read --$C_2H_5$.--.

Signed and Sealed this

Twenty-ninth Day of April, 2008

JON W. DUDAS
*Director of the United States Patent and Trademark Office*